US011014364B2

(12) United States Patent
Burke et al.

(10) Patent No.: US 11,014,364 B2
(45) **Date of Patent: *May 25, 2021**

(54) PRINT MODULE WITH SLIDING PCB ENGAGEMENT MECHANISM

(71) Applicant: MEMJET TECHNOLOGY LIMITED, Dublin (IE)

(72) Inventors: David Burke, North Ryde (AU); Norman Berry, North Ryde (AU); Harrick Selvan Anothonysamy, Singapore (SG); Reynovel Pacinio Anciano, Singapore (SG); Soon Keat Fah, Singapore (SG); Poh Lai Say, Singapore (SG)

(73) Assignee: Memjet Technology Limited

( * ) Notice: Subject to any disclaimer, the term of this patent is extended or adjusted under 35 U.S.C. 154(b) by 0 days.

This patent is subject to a terminal disclaimer.

(21) Appl. No.: 16/591,507

(22) Filed: Oct. 2, 2019

(65) Prior Publication Data

US 2020/0108644 A1 Apr. 9, 2020

Related U.S. Application Data

(60) Provisional application No. 62/740,843, filed on Oct. 3, 2018, provisional application No. 62/864,387, filed on Jun. 20, 2019.

(51) Int. Cl.
*B41J 2/175* (2006.01)
*B41J 29/02* (2006.01)
(Continued)

(52) U.S. Cl.
CPC ..... *B41J 2/175* (2013.01); *B41J 2/16585* (2013.01); *B41J 2/1752* (2013.01); *B41J 2/1753* (2013.01);
(Continued)

(58) Field of Classification Search
CPC ... B41J 29/56; B41J 29/54; B41J 29/02; B41J 2/1752; B41J 2/175; B41J 2/17523;
(Continued)

(56) References Cited

U.S. PATENT DOCUMENTS 6,886,913 B2 5/2005 Nishiberi
2008/0038037 A1 2/2008 Devore et al.
(Continued)

FOREIGN PATENT DOCUMENTS

EP 1968798 B1 12/2010
EP 2177363 B1 5/2012
EP 2065198 B1 3/2013

OTHER PUBLICATIONS

International Search Report and Written Opinion for PCT/EP2019/074749 dated Nov. 28, 2019, 17 pages.
(Continued)

*Primary Examiner* — Geoffrey S Mruk
(74) *Attorney, Agent, or Firm* — Cooley LLP

(57) ABSTRACT

A print module includes: a cradle having a longitudinal cavity; an elongate printhead assembly positioned in the longitudinal cavity; a supply assembly slidably movable relative to the cradle along an axis perpendicular to a longitudinal axis of the printhead assembly, the supply assembly including a PCB fastened to a PCB mounting plate having a resilient flange configured for clamping engagement with a portion of the PCB containing PCB contacts; and a slide plate slidably movable relative to the cradle along an axis parallel to the longitudinal axis of the printhead assembly. The slide plate is configured for camming engagement with the resilient flange and sliding movement of the slide plate urges the resilient flange into clamping engage-
(Continued)

ment with the portion of the PCB containing PCB contacts, thereby electrically connecting the PCB contacts with the printhead.

13 Claims, 21 Drawing Sheets

(51) Int. Cl.

| | |
|---|---|
| ***B41J 29/54*** | (2006.01) |
| ***B41J 2/165*** | (2006.01) |
| ***B41J 29/56*** | (2006.01) |
| ***B41J 25/304*** | (2006.01) |
| *B41J 25/34* | (2006.01) |
| *B41J 2/235* | (2006.01) |

(52) U.S. Cl.
CPC ..... *B41J 2/17523* (2013.01); *B41J 25/304* (2013.01); *B41J 29/02* (2013.01); *B41J 29/54* (2013.01); *B41J 29/56* (2013.01); *B41J 2/17526* (2013.01); *B41J 2/235* (2013.01); *B41J 25/34* (2013.01); *B41J 2202/20* (2013.01)

(58) Field of Classification Search
CPC .. B41J 2/1753; B41J 2/17526; B41J 2/16585; B41J 25/34
See application file for complete search history.

(56) References Cited

U.S. PATENT DOCUMENTS

| | | | | |
|---|---|---|---|---|
| 2011/0096127 | A1 | 4/2011 | Ishibe et al. | |
| 2015/0165777 | A1 | 6/2015 | Mizutani et al. | |
| 2018/0222198 | A1 | 8/2018 | Thelander et al. | |
| 2020/0108603 | A1* | 4/2020 | Burke | B41J 25/304 |

OTHER PUBLICATIONS

International Search Report and Written Opinion for PCT/EP2019/074750 dated Nov. 22, 2019, 16 pages.
International Search Report and Written Opinion for PCT/EP2019/074751 dated Jan. 24, 2020, 24 pages.

* cited by examiner

PRINT MODULE WITH SLIDING PCB ENGAGEMENT MECHANISM

CROSS-REFERENCE TO RELATED APPLICATIONS

The present application claims the benefit of priority under 35 U.S.C. § 119(e) of U.S. Provisional Application No. 62/740,843, entitled PRINT ENGINE AND PRINT MODULE CONFIGURED FOR LONGITUDINAL PRINTHEAD INSERTION, filed Oct. 3, 2018 and of U.S. Provisional Application No. 62/864,387, entitled PRINT ENGINE AND PRINT MODULE CONFIGURED FOR LONGITUDINAL PRINTHEAD INSERTION, filed Jun. 20, 2019, the contents of each of which are hereby incorporated by reference in their entirety for all purposes.

FIELD OF THE INVENTION

This invention relates to a pagewide print engines and print modules therefor. It has been developed primarily for enabling printhead replacement in a print module without requiring access to the print engine from above.

BACKGROUND OF THE INVENTION

Inkjet printers employing Memjet® pagewide technology are commercially available for a number of different printing applications, including desktop printers, digital inkjet presses and wideformat printers. Memjet® printers typically comprise one or more stationary inkjet printhead cartridges having a length of at least 200 mm, which are user-replaceable. For example, a desktop label printer comprises a single user-replaceable multi-colored printhead cartridge, a high-speed inkjet press comprises a plurality of user-replaceable monochrome printhead cartridges aligned along a media feed direction, and a wideformat printer comprises a plurality of user-replaceable printhead cartridges in a staggered overlapping arrangement so as to span across a wideformat pagewidth.

US 2017/0313061 (the contents of which are incorporated herein by reference) describes a commercial pagewide printing system comprising a two-dimensional array of monochrome print modules.

US 2018/0222198 (the contents of which are incorporated herein by reference) describes a full-color pagewide printhead having two rows of chips receiving ink from a common manifold.

Digital multifunction printers (MFPs) employing pagewide inkjet technology are increasingly viewed as a potential replacement for traditional laser MFPs. Digital inkjet technology offers the advantages of high speed, low cost and high print quality. However, in the same way that toner cartridges and fusers are consumables requiring periodic replacement in laser MFPs, various components used in pagewide inkjet printing (e.g. printhead cartridges, ink, service modules etc.) also need periodic replacement. In a typical enterprise multifunction printer, user access to internal components is via one or more door panels positioned at one side of the machine. Likewise, paper drawers are positioned at the same side as the door panels. This allows the machine to be placed against a wall or in a corner of an office, whilst still allowing access for paper-filling and servicing when required. In order for digital inkjet MFPs to compete with traditional laser copiers, there is an expectation among users that digital inkjet machines would maintain a similar form factor and service accessibility compared to their traditional laser counterparts.

Hitherto, digital inkjet print engines having replaceable pagewide printheads required access to the print module from an upper part of the print engine in order to replace the printhead. For example, the print modules described in US 2017/0313061 are lifted upwards from a support cradle for replacement of printhead cartridges.

It would therefore be desirable to provide a digital inkjet print engine employing pagewide technology, whereby replacement of a printhead cartridge can be achieved via side access only. From the foregoing, it will be appreciated that such a print engine will be suitable for use in a digital inkjet multifunction printer/copier as well as other types of pagewide printers requiring convenient replacement of printheads.

SUMMARY OF THE INVENTION

In one aspect, there is provided a print module comprising:

a cradle having a longitudinal cavity;

an elongate printhead assembly positioned in the longitudinal cavity;

a supply assembly slidably movable relative to the cradle along an axis perpendicular to a longitudinal axis of the printhead assembly, the supply assembly comprising a PCB fastened to a PCB mounting plate, the PCB mounting plate having a resilient flange configured for clamping engagement with a portion of the PCB containing PCB contacts; and a slide plate slidably movable relative to the cradle along an axis parallel to the longitudinal axis of the printhead assembly, the slide plate being configured for camming engagement with the resilient flange, wherein sliding movement of the slide plate urges the resilient flange into clamping engagement with said portion of the PCB, thereby electrically connecting the PCB contacts with the printhead.

Preferably, the slide plate comprises a plurality of clamps engaged with complementary cam projections of the resilient flange.

Preferably, the print module comprises a pair of opposed PCBs, each PCB mounted on a respective mounting plate, and wherein sliding movement of opposite slide plates urges respective resilient flanges into clamping engagement with respective portions of the PCBs, thereby electrically connecting the PCB contacts of each PCB with the printhead.

Preferably, the printhead has opposite rows of printhead contacts for connection to opposed rows of PCB contacts.

Preferably, a single actuator handle is operatively connected to each of the opposite slide plates.

Preferably, the actuator handle comprises slide plate pins operatively connected to the slide plates.

Preferably, the slide plate has one or more keepers, and wherein each keeper is engageable with a locking pin projecting from the supply assembly.

Preferably, the slide plate is configurable between a locked position in which each locking pin is engaged with a respective keeper and an unlocked position in which each locking pin is disengaged from respective keeper.

Preferably, the PCB contacts are electrically connected to the printhead in the locked position.

Preferably, the locked position is a printing configuration of the print module.

Preferably, the printhead is urged against a lower nest of the cradle in the locked position.

Preferably, one or more thrust pins of the supply assembly urge the printhead against the nest.

Preferably, each locking pin projects transversely with respect to the longitudinal axis of the printhead assembly.

More generally, there is a provided a print engine comprising a print module as described herein. More generally, there is provided a printer (e.g. a multifunction printer having a side-access panel or door) comprising a print engine as described herein. Print modules, print engines and printers, as described herein, are advantageously suitable for longitudinally loaded printheads.

As used herein, the term "print module" is taken to mean an assembly of components, which include a printhead (e.g. inkjet printhead) for printing. Typically, the print module is itself a component of a print engine, which may comprise other components, such as maintenance components (e.g. capper, wiper etc.) and associated mechanisms for moving such components.

As used herein, the term "print module" is taken to mean an assembly of components, which include a printhead (e.g. inkjet printhead) for printing. Typically, the print module is itself a component of a print engine, which may comprise other components, such as maintenance components (e.g. capper, wiper etc.) and associated mechanisms for moving such components.

As used herein, the term "ink" is taken to mean any printing fluid, which may be printed from an inkjet printhead. The ink may or may not contain a colorant. Accordingly, the term "ink" may include conventional dye-based or pigment based inks, infrared inks, fixatives (e.g. pre-coats and finishers), 3D printing fluids and the like.

As used herein, the term "mounted" includes both direct mounting and indirect mounting via an intervening part.

BRIEF DESCRIPTION OF THE DRAWINGS

Specific embodiments of the present invention will now be described by way of example only with reference to the accompanying drawings, in which.

DETAILED DESCRIPTION OF THE INVENTION

Print Engine

Figure 1:
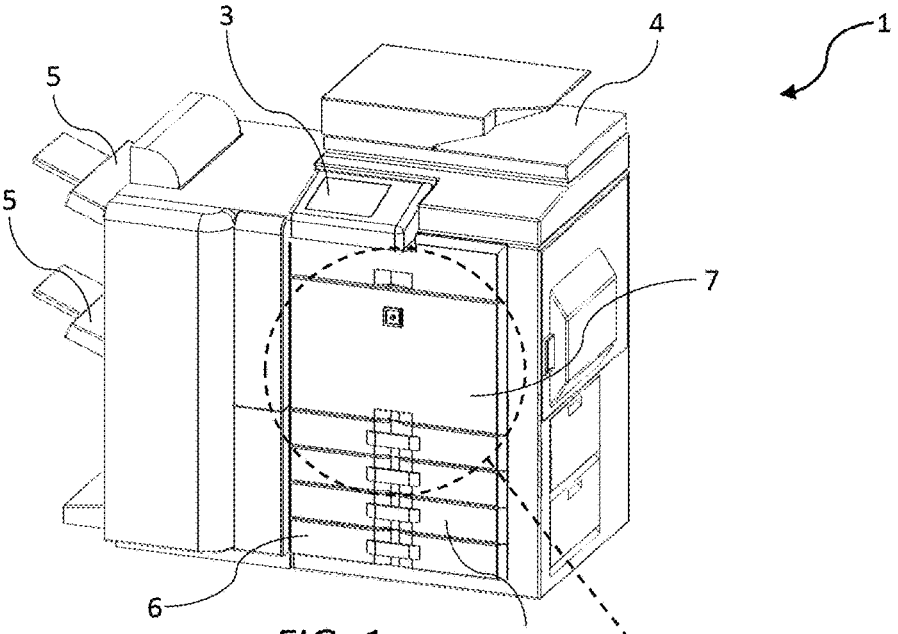
FIG. 1 is a perspective view of a printing device in the form of a digital inkjet MFP.
Figure 1A:
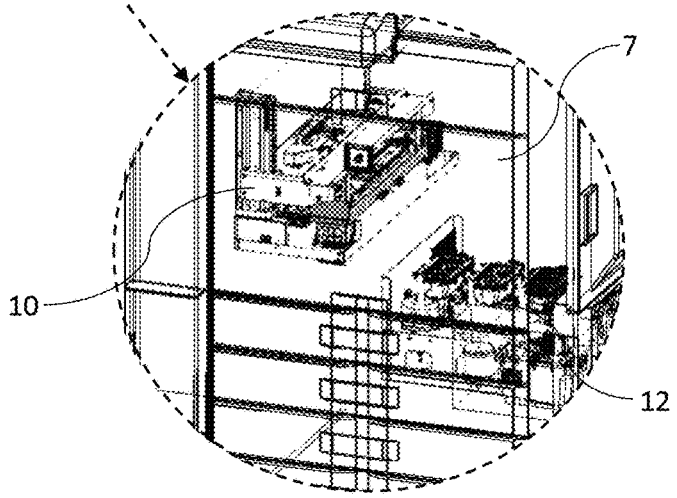
FIG. 1A shows an internal print engine and ink delivery module of the digital inkjet MFP shown in FIG. 1.

Referring to FIG. 1, there is shown a printing device in the form of a digital inkjet multifunction printer 1 ("MFP"). The multifunction printer 1 comprises various standard features, such as a user interface 3, scanner 4 and output trays 5, as well as paper drawers 6 and a user-access panel 7 positioned at a same side as the paper drawers. The user-access panel 7 may be opened by users to allow side access to various internal components of the multifunction printer 1. FIG. 1A shows an inkjet print engine 10 and an associated ink delivery module 12 accessible via the user-access panel 7. The print engine 10 is specifically configured for longitudinally side-loading of a printhead, as will be described in detail below.

Figure 2:
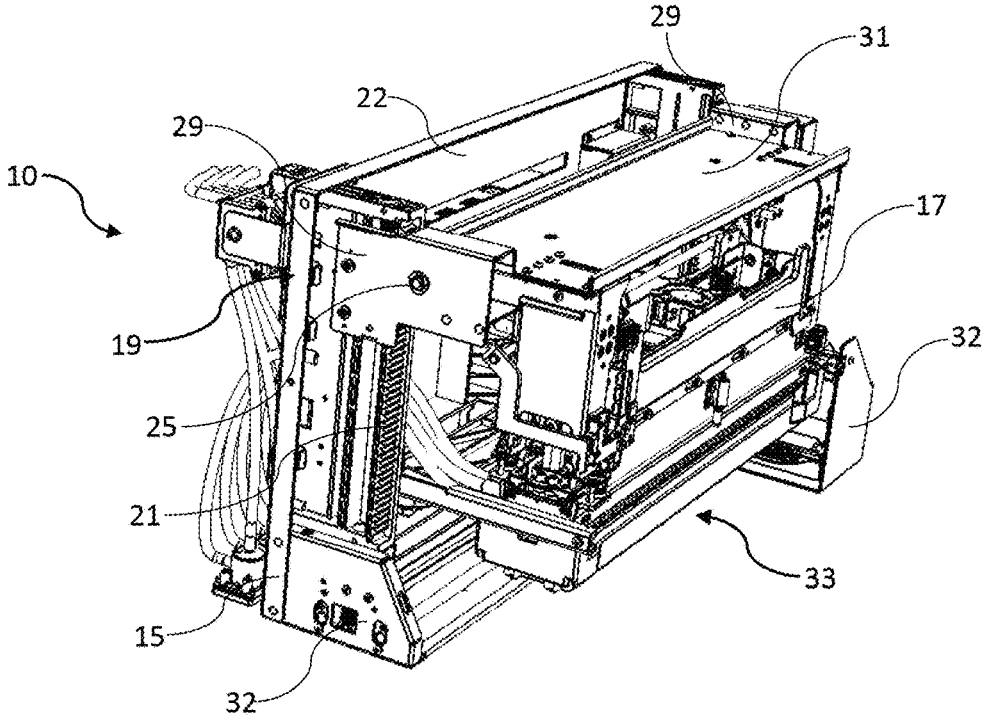
FIG. 2 is a side perspective of the print engine.
Figure 3:
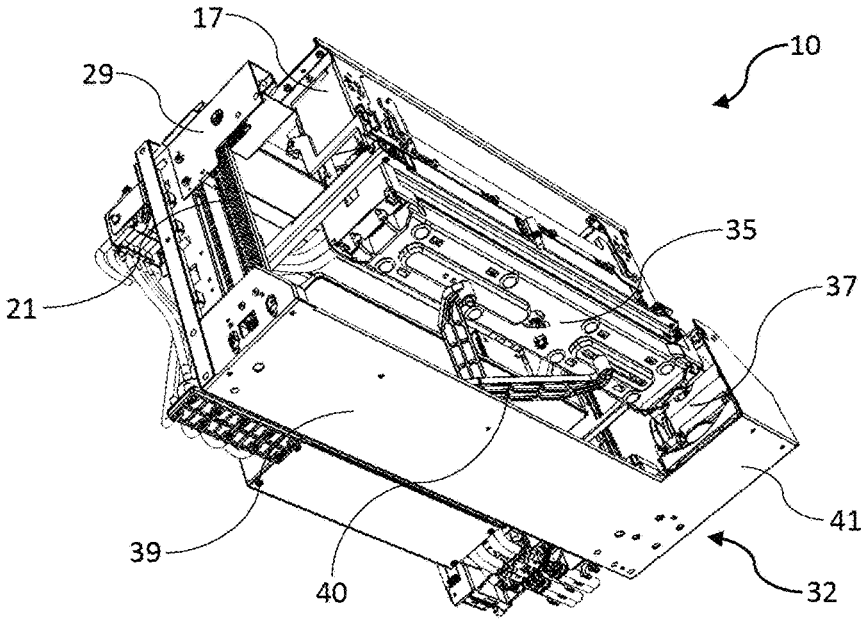
FIG. 3 is a bottom perspective of the print engine.
Figure 4:
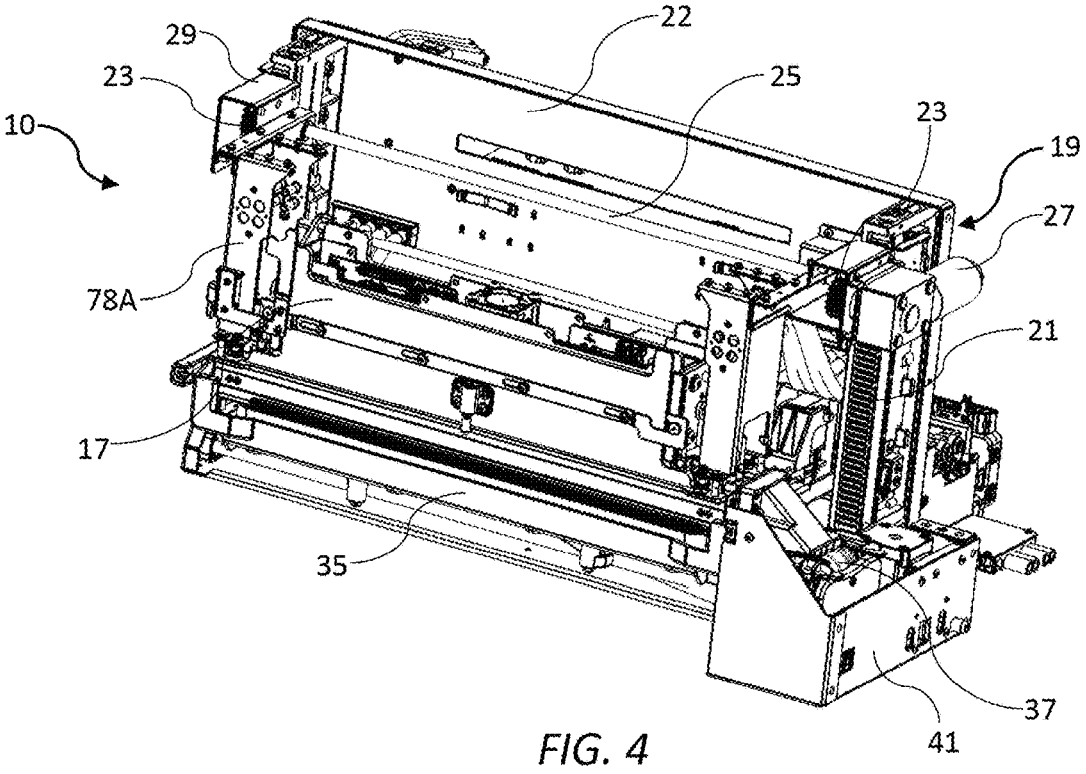
FIG. 4 is a front perspective of the print engine.

Referring to FIGS. 2 to 4, the print engine 10 is shown in isolation. The print engine 10 comprises a chassis 15 for fixedly mounting to a frame (not shown) of the multifunction printer 1. A first print module 17 is movably connected to the chassis 15 via a module lift mechanism 19 for raising and lowering the print module relative to the chassis. The print engine 10 is shown with the first print module 17 in its raised (maintenance) position in FIGS. 2 to 4 and with the print module in its lowered (printing) position in FIG. 1A.

The module lift mechanism 19 takes the form of a rack-and-pinion mechanism comprising a pair of racks 21 mounted to opposite ends of a backplate 22 of the chassis 15 and a corresponding pair of pinions 23 engaged with the racks, the pair of pinions being fixedly mounted about an interconnecting pinion shaft 25. The module lift mechanism 19 is driven by a lift motor 27 operatively connected to one of the pinions 23 for moving the pair of pinions along the racks via rotation of the interconnecting pinion shaft 25.

The pinion shaft 25 is rotatably mounted between a pair of lift brackets 29 housing respective pinions 23, such that the lift brackets may be lowered or raised by the module lift mechanism 19. The lift brackets 29 are interconnected via an elongate mounting beam 31 extending longitudinally along a length of the print engine 10. An upper portion of the print module 17 has suitable mounting fixtures 30 for fixed attachment to the mounting beam 31 (see FIG. 6). Hence, the first print module 17 may be raised and lowered via actuation of the lift motor 27 between a maintenance position (FIGS. 2 to 4) and a printing position (FIG. 1A), respectively. A spring mechanism (not shown) engaged with the lift brackets 29 may be used to assist in raising the first print module 17, while a bearing slider (not visible in FIGS. 2 to 4) attached to each lift bracket bears against one side of each rack 21 to counteract the moment of the print module.

Figure 5:
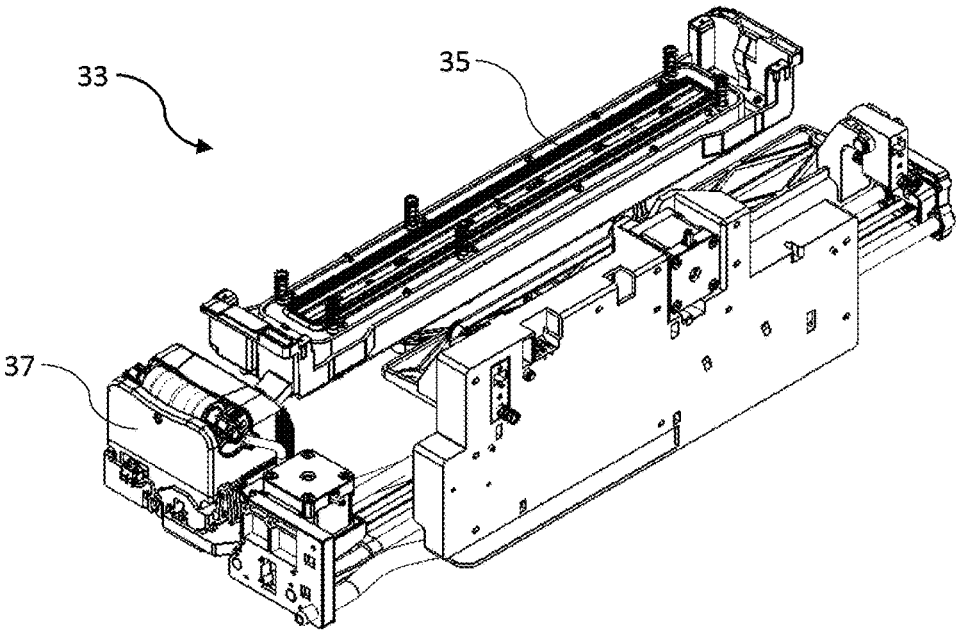
FIG. 5 shows a maintenance sub-assembly of the print engine.

A lower portion of the chassis 15 comprises an L-shaped frame 32 fixed to the backplate 22. The L-shaped frame 32 houses a maintenance sub-assembly 33 of the print engine 10 and is shown in isolation in FIG. 5. The maintenance sub-assembly 33 comprises a printhead capper 35 and a wiper carriage 37 for performing maintenance operations on an elongate inkjet printhead 50 of the first print module 17. The printhead capper 35, which is housed in a longer arm 39 of the L-shaped frame, is laterally extendible from the backplate 22 of the chassis 15 via a scissor mechanism 40 for capping the printhead. The wiper carriage 37, which is housed in a shorter arm 41 of the L-shaped frame, is traversable along a longitudinal axis of the first print module 17 for wiping the printhead. In the configuration shown in FIGS. 2 to 5, the capper 35 is in its laterally extended position with the printhead capped, and the wiper carriage 37 is in its parked or 'home' position housed within the shorter arm 41 of the L-shaped frame 32. The maintenance sub-assembly 33 is similar in both function and mechanism to the maintenance module described in US 2017/0313061, the contents of which are incorporated herein by reference. Accordingly, for a more detailed description of the function and mechanism of the maintenance sub-assembly 33, the skilled person is referred to US 2017/0313061.

Print Module (First Embodiment)

Figure 6:
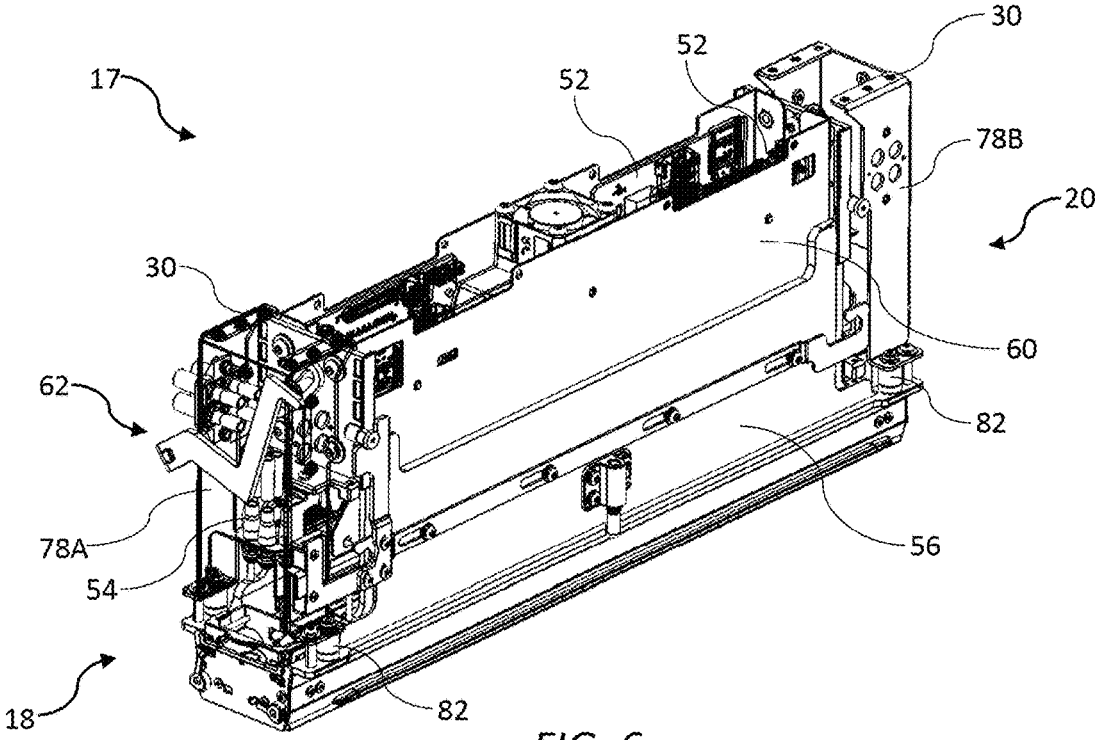
FIG. 6 is a front perspective view of a print module according to a first embodiment.
Figure 7:
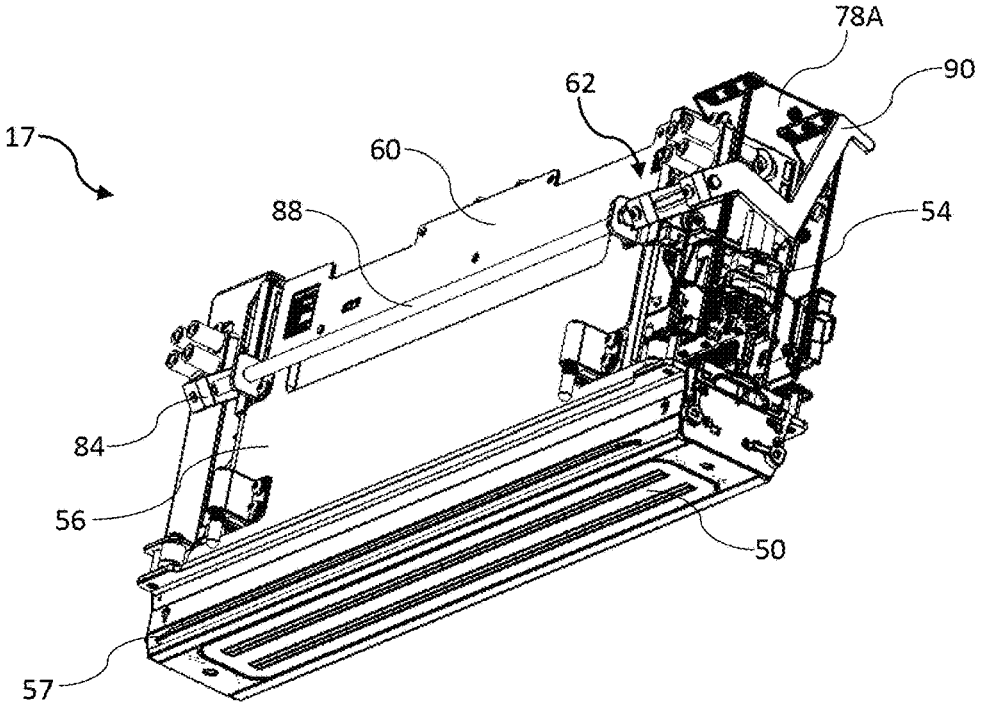
FIG. 7 is a rear perspective of the print module according to the first embodiment.

Referring to FIGS. 6 and 7, the first print module 17 according to a first embodiment is shown in isolation. The first print module 17 is generally elongate and serves the primary function of detachably mounting the printhead cartridge 50 (or "printhead 50") shown in FIG. 8. (The printhead cartridge 50 is described in detail in US 2018/0222198, the contents of which are incorporated herein by reference). The first print module 17 houses a pair of opposed PCBs 52 and a pair of ink couplings 54, as well as various mechanisms for detachably connecting the PCBs and ink couplings to the printhead 50 and inserting/removing the printhead from the print module. In particular, the first print module 17 comprises a cradle 56 and a movable supply assembly 60.

Figure 9:
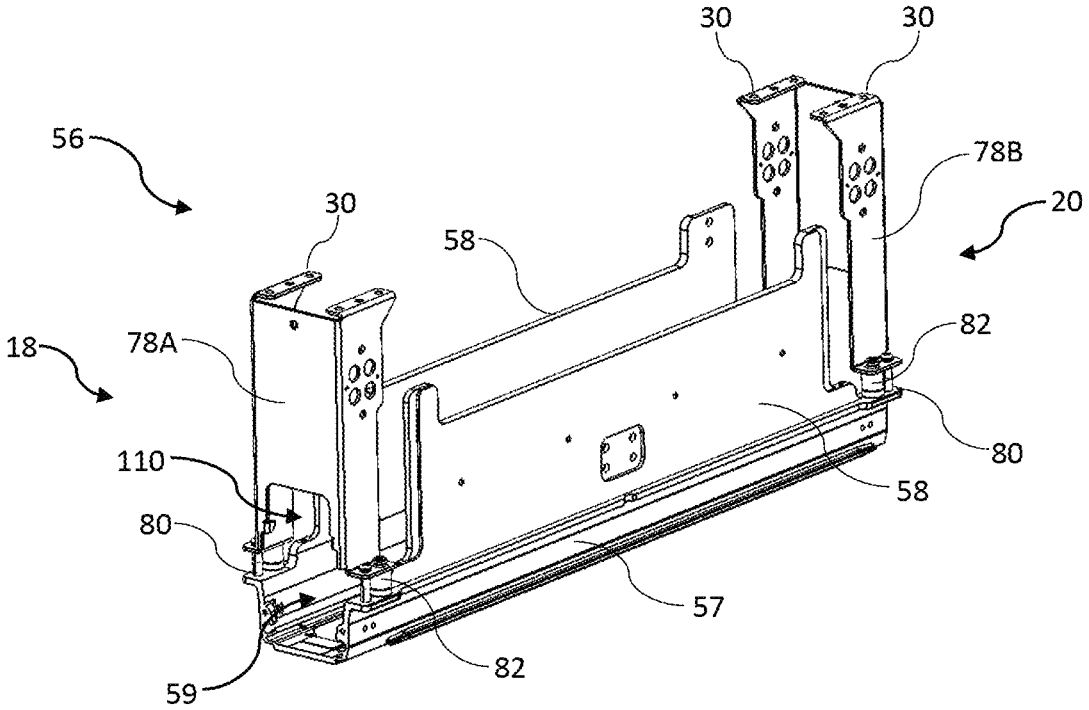
FIG. 9 is a perspective of a cradle for the print module according to the first embodiment.

Referring to FIG. 9, the cradle 56 comprises a lower nest 57 defining a longitudinal cavity 59 for receiving the printhead 50; front and rear cradle side plates 58 extending upwardly from the nest; and first and second end housings 78A and 78B fastened to the nest. Each of the first and second end housings 78A and 78B has a foot portion connected to anchor points 80 of the nest 57 and an upper portion containing the mounting fixtures 30 for attachment to the mounting beam 31 of the print engine 10. A resilient fastening arrangement 82 is used to attach the end housings 78A and 78B to the anchor points 80 in order to provide a degree of tolerance for the module lift mechanism 19 when datuming the print module 10 into its printing and maintenance positions.

The supply assembly 60 is slidably received in the cradle 56 between the front and rear cradle side plates 58, the supply assembly being liftable towards and away from the nest 57 (containing the printhead 50) by means of a lever mechanism 62 as will be described in more detail below.

Figure 10:
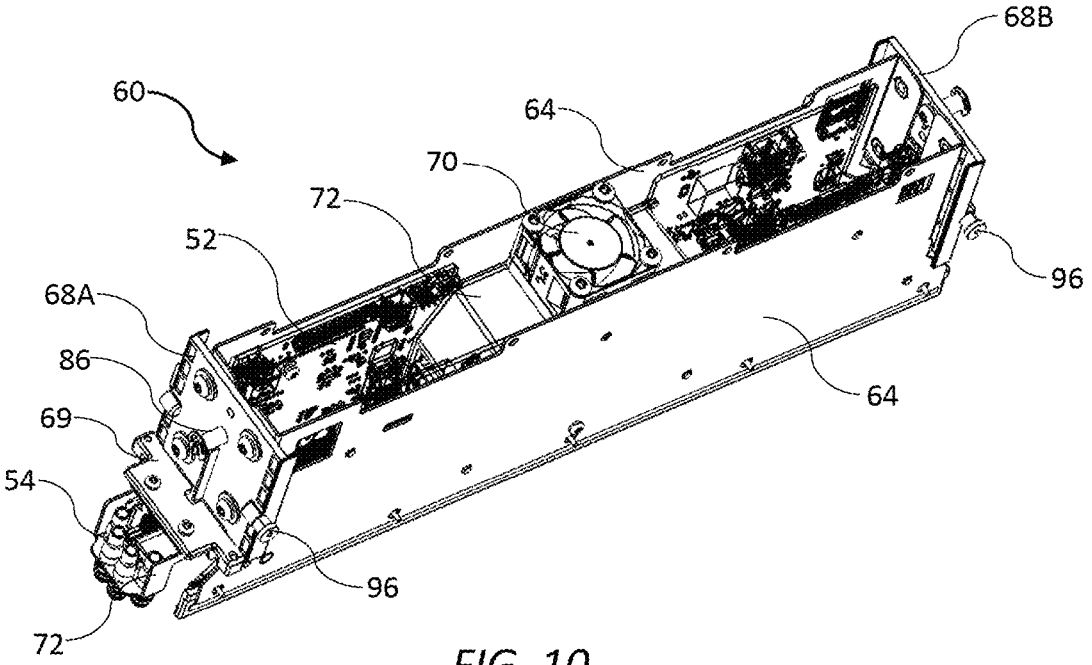
FIG. 10 is a top perspective of a supply assembly for the print module according to the first embodiment.
Figure 11:
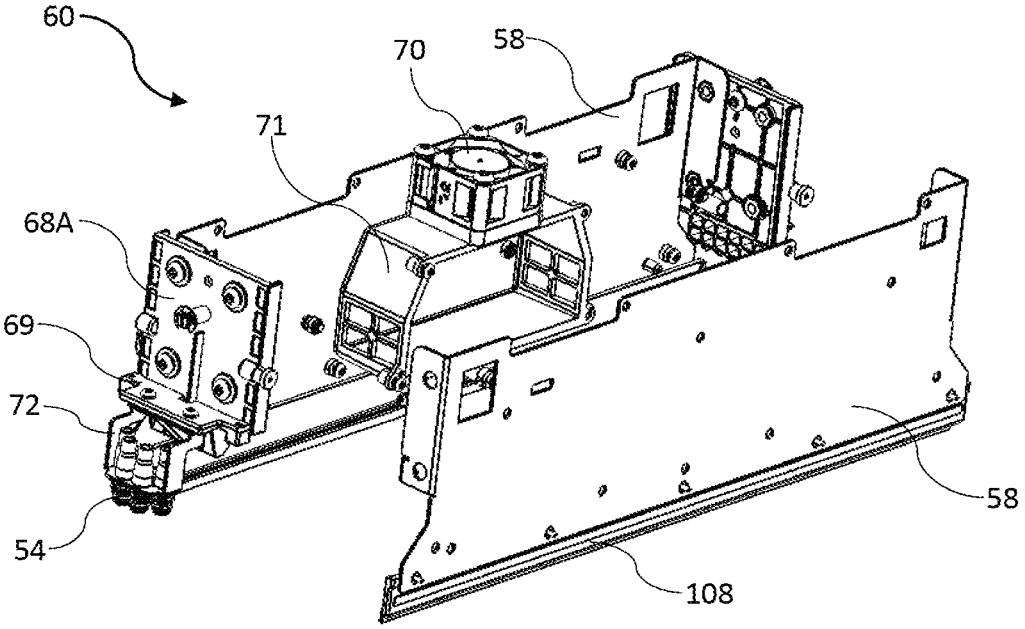
FIG. 11 is an exploded perspective of the supply assembly shown in FIG. 10 with PCBs removed.
Figure 12:
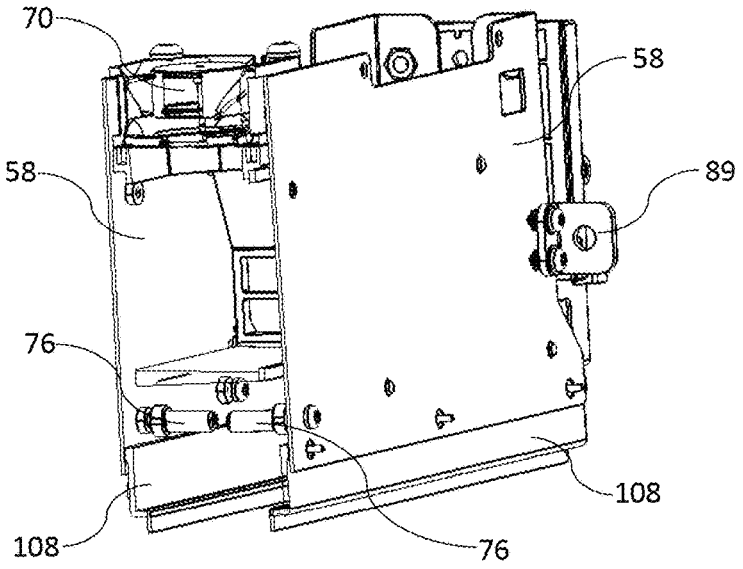
FIG. 12 is a sectional perspective of the supply assembly shown in FIG. 10 with PCBs removed.

Referring to FIGS. 10 to 12, the supply assembly 60 comprises a pair of front and rear PCB mounting plates 64 extending parallel with the cradle side plates 58. As shown in FIG. 10, the opposed PCBs 52 are each fastened to a respective PCB mounting plate 64 with a space defined between the opposed PCBs. A fan assembly braced between the two PCB mounting plates 64 comprises a fan 70 and ducting arrangement 71 to provide airflow into the space between the PCBs 52 for cooling various electronic components. Structural rigidity is provided by first and second end brackets 68A and 68B interconnecting the front and rear PCB mounting plates 64.

Each of the first and second end brackets 68A and 68B has a mounting bracket 69 extending longitudinally outwardly therefrom for mounting a set of ink couplings 54 via a respective ink coupling bracket 72 hanging from the mounting bracket. Hence, the ink couplings 54 are fast with the supply assembly 60 and move in concert with the PCBs 52. There are two sets of ink couplings 54 at opposite ends of the supply assembly 60 corresponding to inlet ports 74 and outlet ports 75 at opposite ends of the printhead 50.

The two sets of ink couplings 54, ink coupling brackets 72 and mounting shelves 69 positioned at opposite ends of the first print module 17 are contained in respective first and second end housings 78A and 78B of the cradle 56. The first end housing 78A at the first end of the first print module 17 is shown transparent in FIGS. 6 and 7 to reveal the ink couplings 54 and associated mountings.

Figure 13:
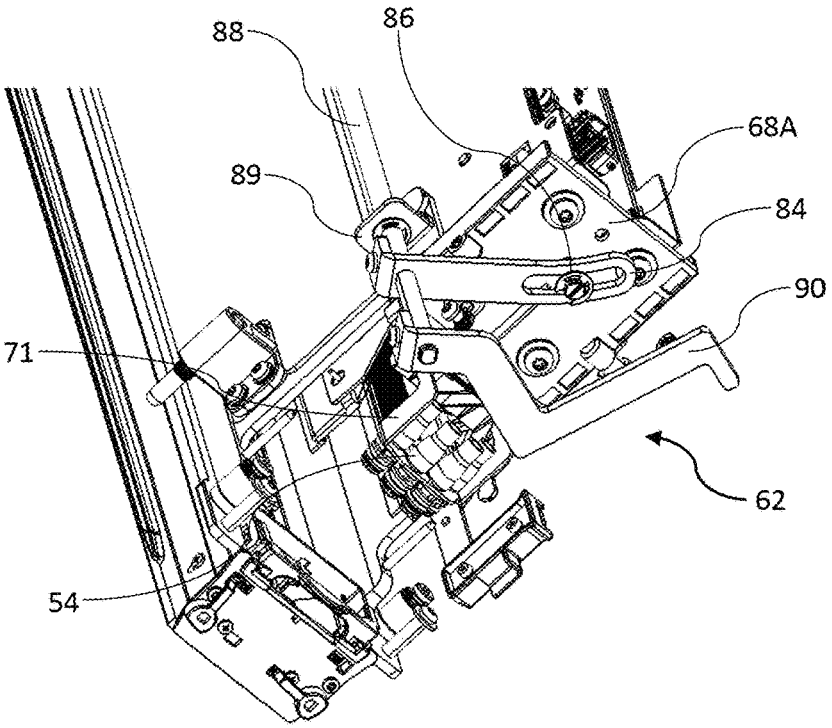
FIG. 13 is shows a lever mechanism at a first end of the print module according to the first embodiment.

Referring now to FIGS. 7 and 13, movement of the supply assembly 60 relative to the cradle 56 is effected by means of a lever mechanism 62. The lever mechanism 62 comprises a pair of cam levers 84 engaged with respective spigots 86 projecting outwardly from the first and second end brackets 68A and 68B. The cam levers 84 are fixedly mounted about a lever shaft 88 extending longitudinally along a rear face of the first print module 17 and supported by bushings 89 fixed to the rear PCB mounting plate 64. One end of the lever shaft 88 extends beyond the first end housing 78A and has a lever handle 90 for user actuation. Clockwise rotation (as shown in FIGS. 7 and 13) of the lever handle 90 and lever shaft 88 actuates the lever mechanism 62 via camming engagement between the cam levers 84 and spigots 86, thereby causing downward movement of the supply assembly 60 towards the printhead 50. The ink couplings 54 are quick-connect couplings, which form fluidic connections to the printhead 50 once lowered into engagement with the printhead inlet ports 74 and outlet ports 75. Conversely anticlockwise rotation of the lever handle 90 raises the supply assembly 60 and disengages the ink couplings 50 from the printhead inlet and outlet ports 74 and 75.

Figure 8:
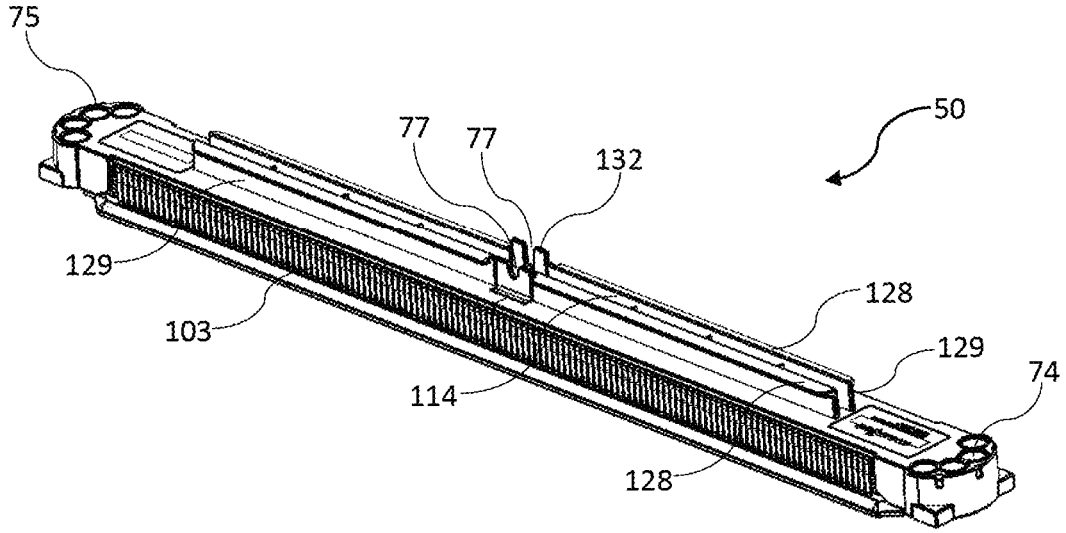
FIG. 8 is a perspective of an inkjet printhead.

Referring to FIGS. 8 and 12, the supply assembly 60 comprises a pair of opposed thrust pins projecting transversely inwards from each of the PCB mounting plates 58. The thrust pins 76 are positioned for alignment with complementary notches 77 defined in a central portion of the printhead 50. When the lever mechanism 62 is actuated to move the supply assembly 60 towards the printhead 50, the thrust pins 76 engage with the notches 77 to urge the printhead 50 downwards into seated (datumed) engagement with the nest 57. Thus, the elongate printhead 50 experiences a downward force at each end via the ink couplings 54 and in a middle portion via the thrust pins 76.

Figure 14:
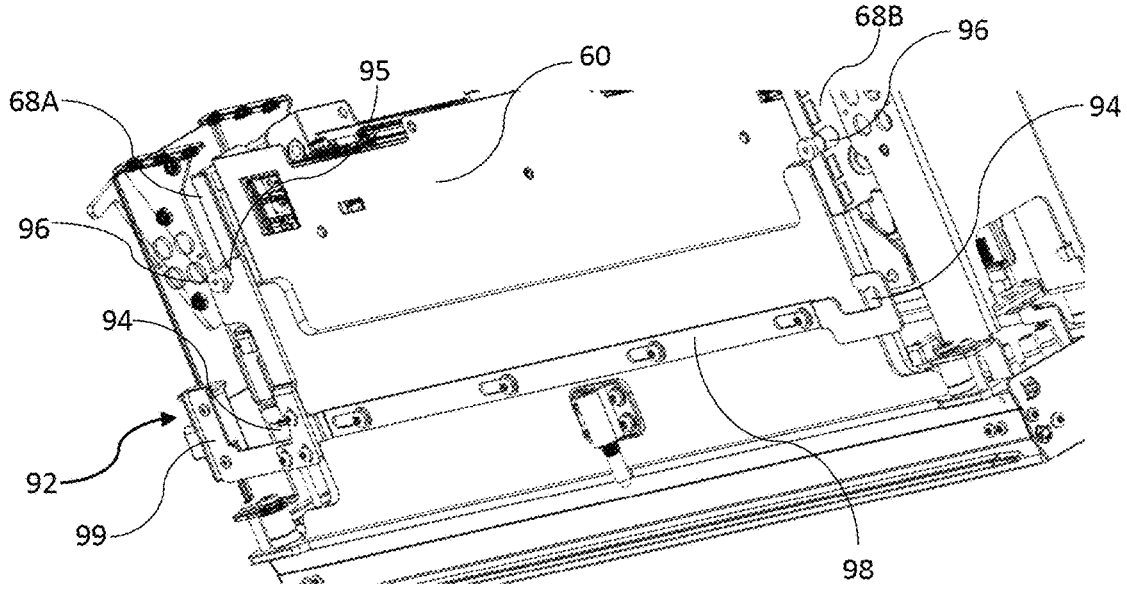
FIG. 14 shows a sliding lock mechanism of the print module according to the first embodiment.

Referring to FIG. 14, a sliding lock mechanism 92 is used to hold the supply assembly 60 in either its raised or lowered position. The lock mechanism 92 comprises first and second keepers 94 configured for locking engagement with transversely projecting locking pins 96 of the first and second end brackets 68A and 68B. The pair of keepers 94 are connected via a slide plate 98, which is longitudinally slidably movable by pushing on a lock handle 99 connected to the slide plate at the first end in order to disengage the keepers 94 from the locking pins 96 and allow movement of the supply assembly 60 using the lever mechanism 62. Once the supply assembly 60 has been lowered into position, pulling the lock handle 99 back towards the first end of the first print module 17 re-engages the respective keepers 94 and locking pins 96 so as to prevent movement of supply assembly and effectively disable the lever mechanism 62. As shown in FIG. 14, the supply assembly 60 is in its raised position with the locking pins 96 disengaged from the keepers 94. In this raised position, the locking pin 96 at the first end is engaged with a holding feature 95 positioned above the first keeper 94. The holding feature 95 is connected to the slide plate 98 and serves the purpose of the holding the supply assembly 60 in its raised position during printhead removal and replacement.

Figure 15A:
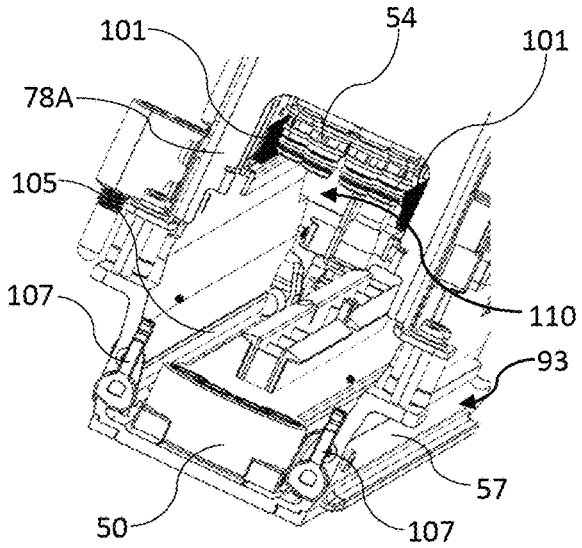
FIGS. 15A and 15B show a PCB clamp mechanism.
Figure 15B:
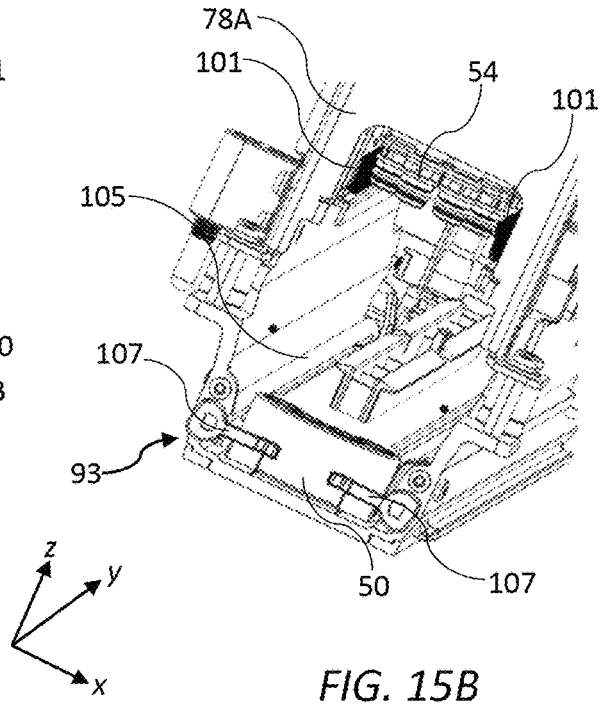

As described above, ink connections to the printhead 50 are made by lowering the supply assembly 60 along a nominal z-axis using the lever handle 90 of the lever mechanism 62. With the supply assembly 60 in its lowered position, opposed rows of PCB contacts 101 are positioned adjacent respective printhead contacts 103 extending along opposite longitudinal sides of the printhead 50. However, electrical connections between the supply assembly 60 and the printhead 50 are formed in a separate step from the ink connections, thereby minimizing the forces required when replacing a printhead 50 from only one end of the print engine 10. Referring now to FIGS. 15A and 15B, a pair of clamp rods 105 are longitudinally rotatably mounted in the nest 57, each clamp rod extending parallel with a respective row of PCB contacts 101. The clamp rods 105 are each independently rotatable by means of a respective clamp lever 107 fixedly mounted to the clamp rods and positioned at the first end of the first print module 17. Each clamp rod 105 is configured for camming engagement with a respective resilient flange 108 extending from a lower part of each PCB mounting plate 58. Each resilient flange 108 is aligned with the PCB contacts 101 of a respective PCB 52 and, with the supply assembly 60 in its lowered positioned, each resilient flange is positioned between a respective clamp rod 105 and a respective row of printhead contacts 103. In the embodiment shown, each clamp rod 105 has a longitudinal cutout facing the printhead 50 when the clamp rod is in its unclamped position (FIG. 13A) such that the PCB contacts 101 are disengaged from the printhead contacts 103. Rotation of the clamp levers 107 towards each other clamps the PCB contacts 101 against the printhead contacts 103 along a nominal x-axis via the camming action of the clamp rods 105 against the resilient flanges 108. FIG. 15A shows the clamp rods 105 in their unclamped positions and FIG. 15B shows the clamp rods in their clamped positions. (The supply assembly 60 is shown in its raised position in FIG. 15B, although it will be appreciated that clamping of the PCB contacts 101 against the printhead contacts 103 requires the supply assembly to be lowered).

The first end housing 78A at the first end of the first print module 17 defines an access opening 110 for longitudinal insertion and removal of the printhead 50 along a nominal y-axis. The printhead carrier 112 is pivoted about a pivot axis 116 transverse to the longitudinal axis of the first print module 17 at the second end thereof, such that one end of the printhead carrier proximate the access opening 110 at the first end of the print module can be lifted into a printhead access position.

Figure 16A:
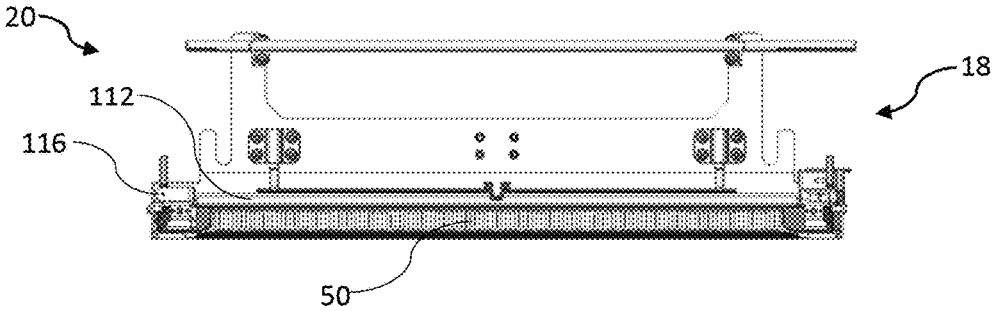
FIGS. 16A-C are schematic side views showing removal of a printhead from a pivoting printhead carrier.
Figure 16B:
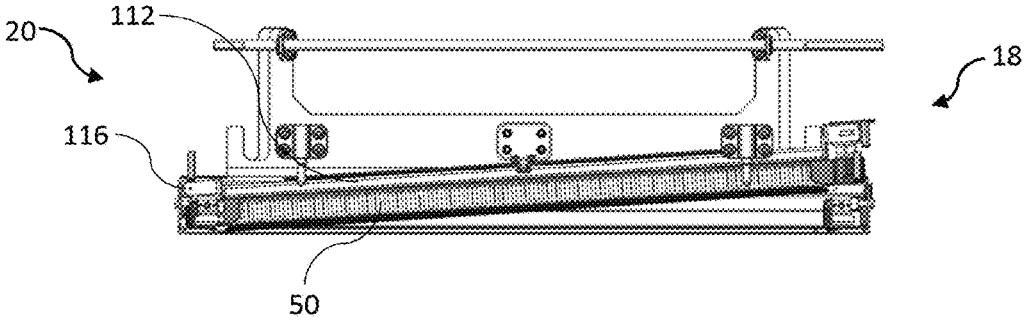
Figure 16C:
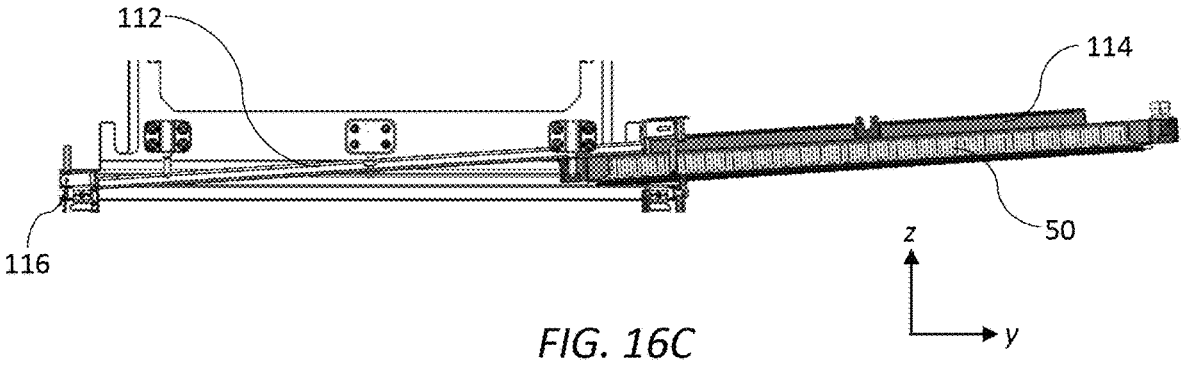

FIGS. 16A-C show the basic pivoting motion of the printhead carrier 112 for removal of the printhead 50. In FIG. 16A, the printhead is fully engaged with the printhead carrier and seated horizontally in the nest 57 in a printing configuration. In FIG. 16B, the printhead 50 is still fully engaged with the printhead carrier 112, but the printhead carrier has been pivoted about the pivot axis 116 at the second end of the nest 57, such that the first end of the printhead carrier 112 (and printhead 50) is raised relative to the second end. In FIG. 16C, the printhead 50 is being longitudinally slidably removed from the printhead carrier 112 by means of pulling the printhead away from the printhead carrier and through the access opening 110 of the cradle 56.

Figure 17:
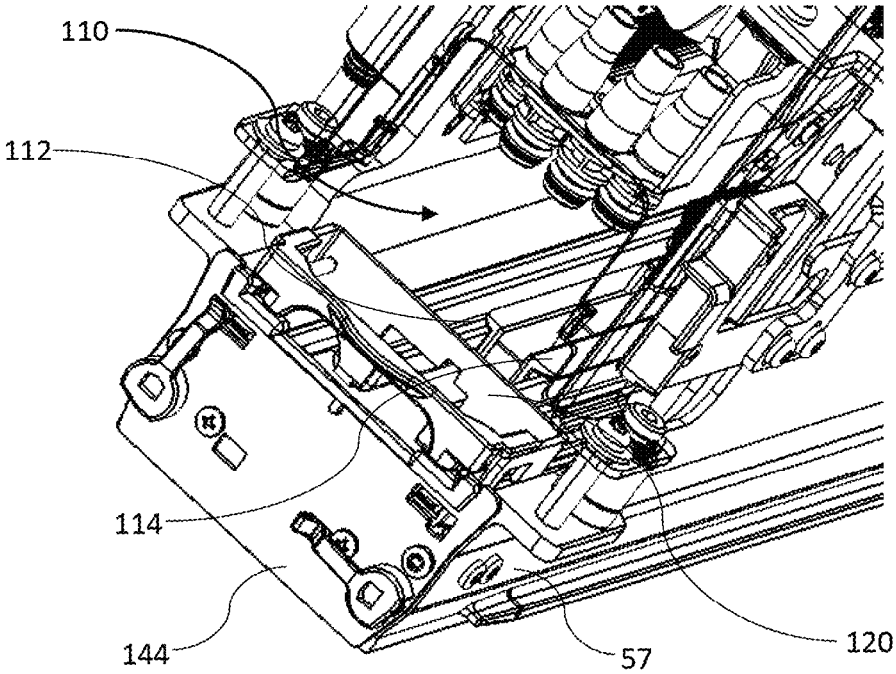
FIG. 17 is a magnified view of a first end of the print module according to the first embodiment.
Figure 18:
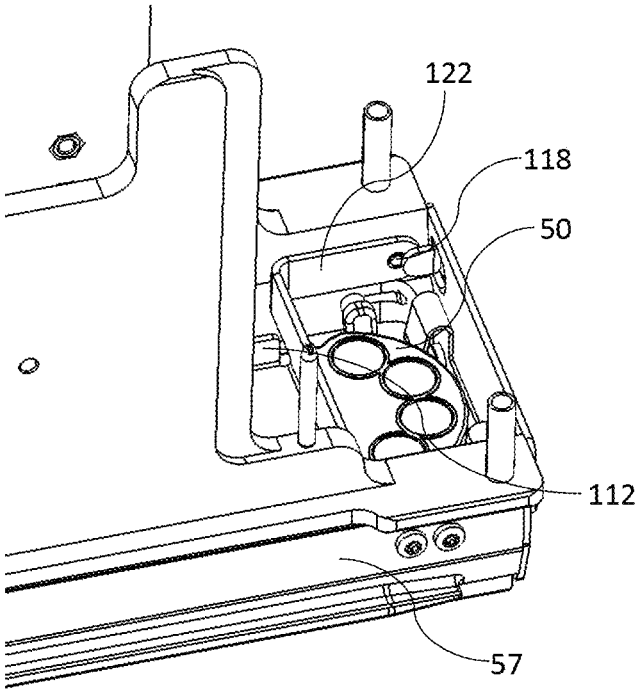
FIG. 18 is a magnified view of a second end of the print module according to the first embodiment.

FIGS. 17 and 18 are magnified views of the first and second ends, respectively, of the first print module 17. In FIG. 17, the overhead hanger 114 of the printhead 50 is engaged with the printhead carrier 112 and visible through the access opening 110. In FIG. 18, a pair of trunnions 118 (only one trunnion visible in FIG. 18) define the pivot axis 116 and provide pivoting engagement between a pivot bracket 122 of the printhead carrier 112 and the nest 57.

Figure 19:
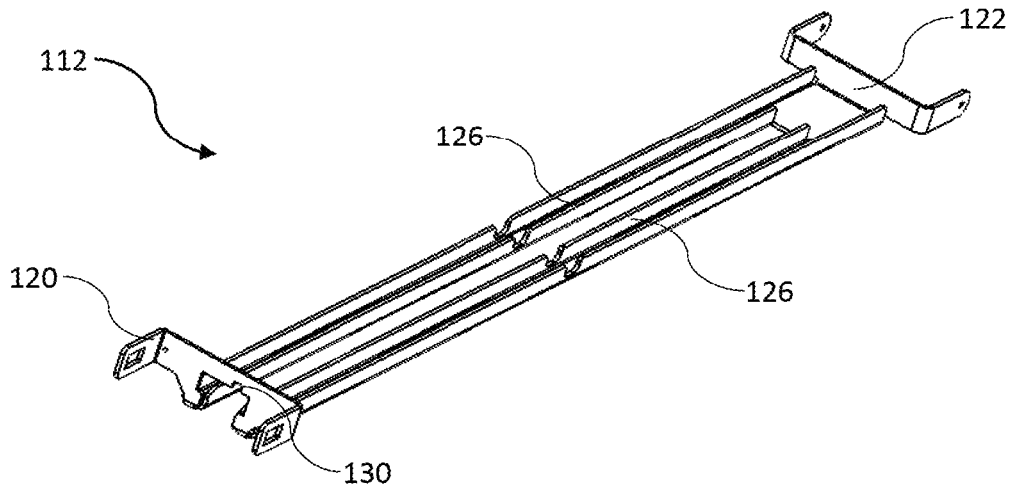
FIG. 19 is a perspective of the printhead carrier for the print module according to the first embodiment.

The printhead carrier 112, shown in isolation in FIG. 19, comprises a latch bracket 120 at its first end and a pivot bracket 122 at its second end with a pair of spaced apart rails 126 extending therebetween. The rails 126 are configured for hanging the overhead hanger 114 of the printhead 50 when the printhead is slidably inserted into printhead carrier 112 from the first end. Referring briefly to FIG. 8, the overhead hanger 114 is generally T-shaped comprising a pair of elongate flanges 128 extending transversely in opposite directions from respective mounting bars 129 on an upper part of the printhead 50. Returning to FIG. 19, the latch bracket 120 comprises an asymmetrical keying feature 130 in the form of a key notch for keying engagement with a complementary key projection 132 extending upwards from the printhead 50. The keying feature 130 and complementary key projection 132 ensure that the printhead 50 can only be slidably inserted into the printhead carrier 112 in a correct orientation.

Figure 20:
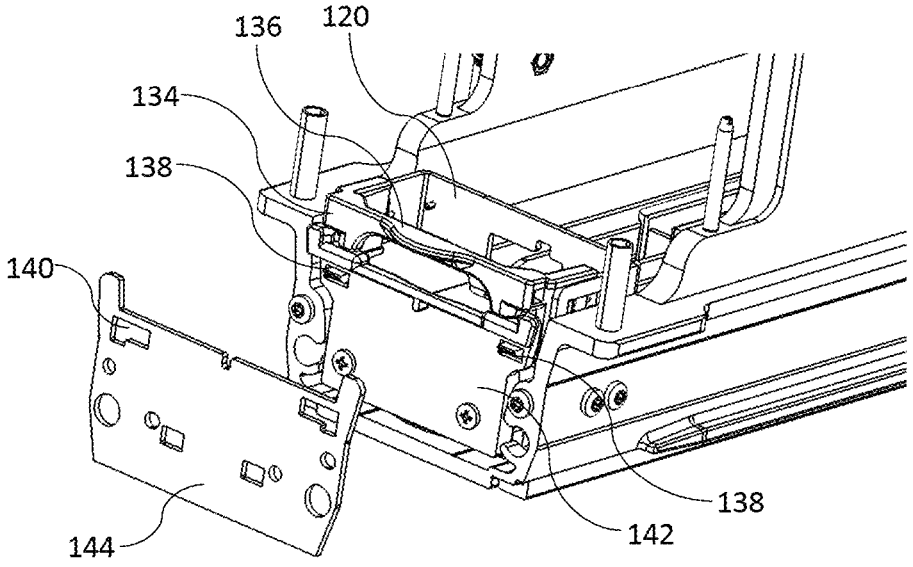
FIG. 20 shows a latch mechanism for the printhead carrier shown in FIG. 19 in a latched position.
Figure 21:
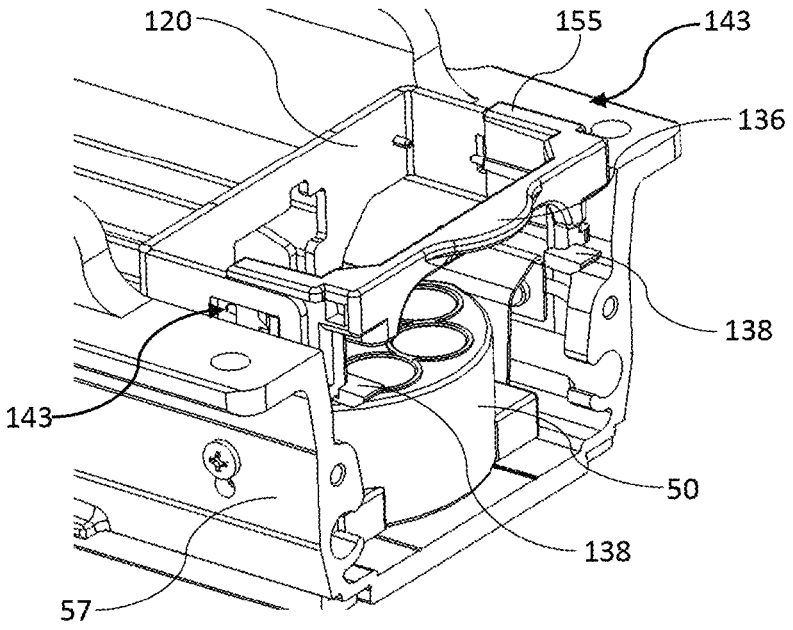
FIG. 21 shows the latch mechanism shown in FIG. 20 with a guide plate removed.
Figure 22:
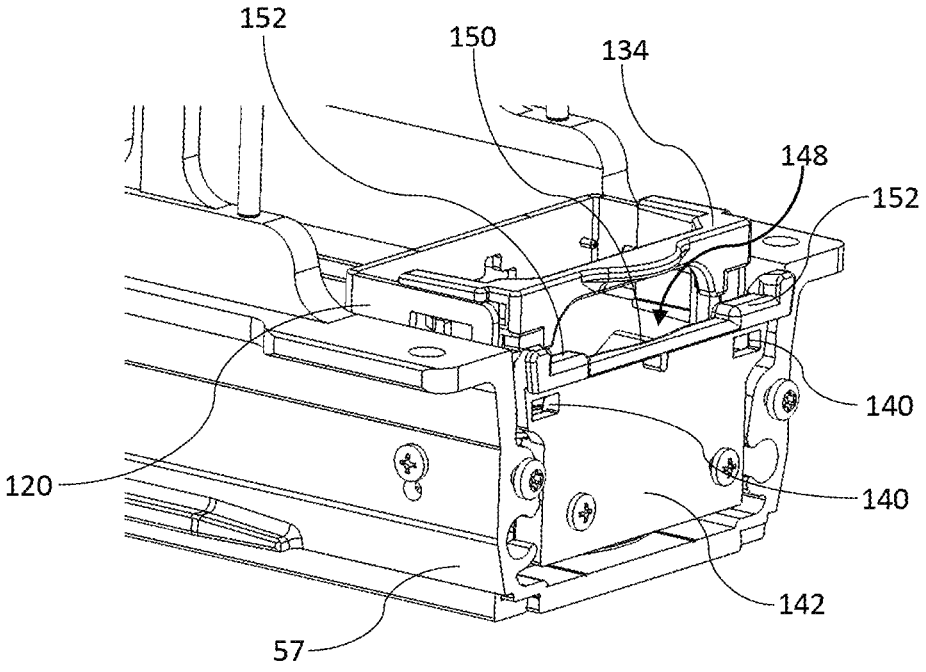
FIG. 22 shows the latch mechanism shown in FIG. 20 in an unlatched position.

Referring to FIGS. 20 to 22, a latch 134 is slidably connected to the latch bracket 120 for either latching or releasing the printhead carrier 112, thereby either latching the printhead 50 in its printing position or allowing pivoting movement of the printhead carrier for removal of the printhead. The latch 134 is engaged in a pair of slots of the latch bracket 120 for sliding movement along a longitudinal axis of the first print module 17. The latch 134 comprises a latch handle 136 for user actuation and a pair of tabs 138 for latching engagement with complementary latch slots 140 defined in a guide plate 142 at the first end of the nest 57 (as well as a nest endplate 144). FIG. 20 shows the latch 134 in its latched configuration with the tabs 138 engaged in the latch slots 140 of the guide plate 142. In FIG. 21, the guide plate 142 and nest endplate 144 have been removed to reveal the sliding mechanism 143 of the latch relative to the latch bracket 120 as well as the tabs 138. FIG. 22 shows the latch 134 in its unlatched position with the latch handle 136 pushed inwards and the tabs 138 disengaged from the latch slots 140. In this unlatched configuration, the printhead carrier 112 is free to pivot about the pivot axis 116 such that the first end of the printhead 50 can be raised into alignment with the access opening, thereby enabling sliding longitudinal removal of the printhead from the print module (FIGS. 16B and 16C).

The guide plate 142 is formed of a suitable material (e.g. plastics) to allow the printhead to slide freely along its upper surface during insertion or removal of the printhead. Further, as best seen in FIG. 20, an upper guide surface 148 of the guide plate 142 is profiled such that the printhead 50 can be removed from the first print module 17 without its ink ejection face being damaged. Specifically, the guide surface 148 has a central recess 150 positioned between a pair of support shoulders 152. The support shoulders 152 contact lower longitudinal edge regions of the printhead 50 while the recess 150 is spaced apart from an ink ejection face of the printhead (containing sensitive printhead chips), thereby minimizing any potentially damaging contact between the first print module 17 and the ink ejection face during longitudinal removal or insertion of the printhead.

Figure 23A:
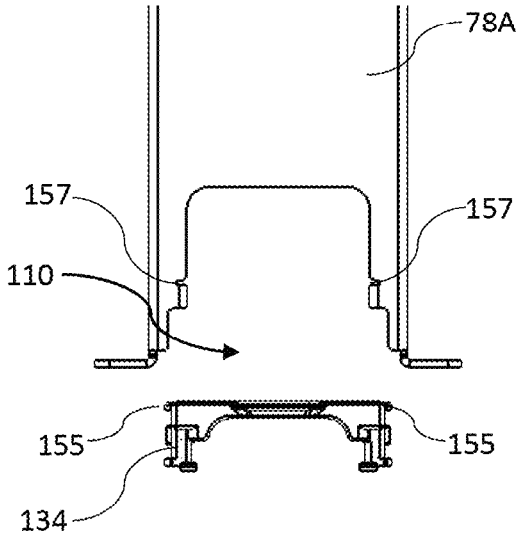
FIGS. 23A and 23B are schematic end views of the print module according to the first embodiment showing the latch in its lowered and raised positions.
Figure 23B:
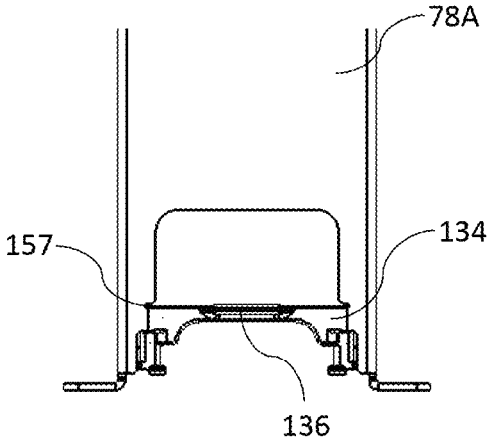

In order to remove the printhead 50 from the first print module 17, a user facing the first end of the print module performs the following sequence of steps. First, the clamp levers 107 are rotated in opposite directions to unclamp the PCB contacts 101 from the printhead contacts 103. Next, the lock handle 99 is pushed inwards in order to release the lever mechanism 62. With the lever mechanism released, the lever handle 90 is rotated anticlockwise to disengage the ink couplings 54 from the printhead 50 and raise the supply assembly 60 away from the printhead. Next, the latch handle 138 is pushed inwards to unlatch the printhead carrier 112 and, still holding the latch handle, the printhead carrier 112 is pivoted upwards so that the printhead 50 aligns with the access opening 110 of the cradle 56. (As best shown in FIGS. 23A and 23B, the latch 134 has opposite winglets 155 configured for supporting the printhead carrier 112 via engagement with retaining notches 157 defined in the access opening 110 when the latch is raised). With the first end of the printhead carrier 112 raised and retained by the retaining notches 157, the printhead 50 can then be removed from the first print module 17 by longitudinally sliding the printhead relative to the printhead carrier 112 and out through the access opening 110. The reverse sequence of steps is used to insert a replacement printhead 50 into the first print module 17.

It will be appreciated that all steps in the sequence described above may be performed by a user who may have access to only one end of the print engine 10. Therefore, the print engine 10 is suitable for use in a multifunction printer of the type described above having a user-access panel positioned in one side of the printer.

Second Print Module (Second Embodiment)

Figure 24:
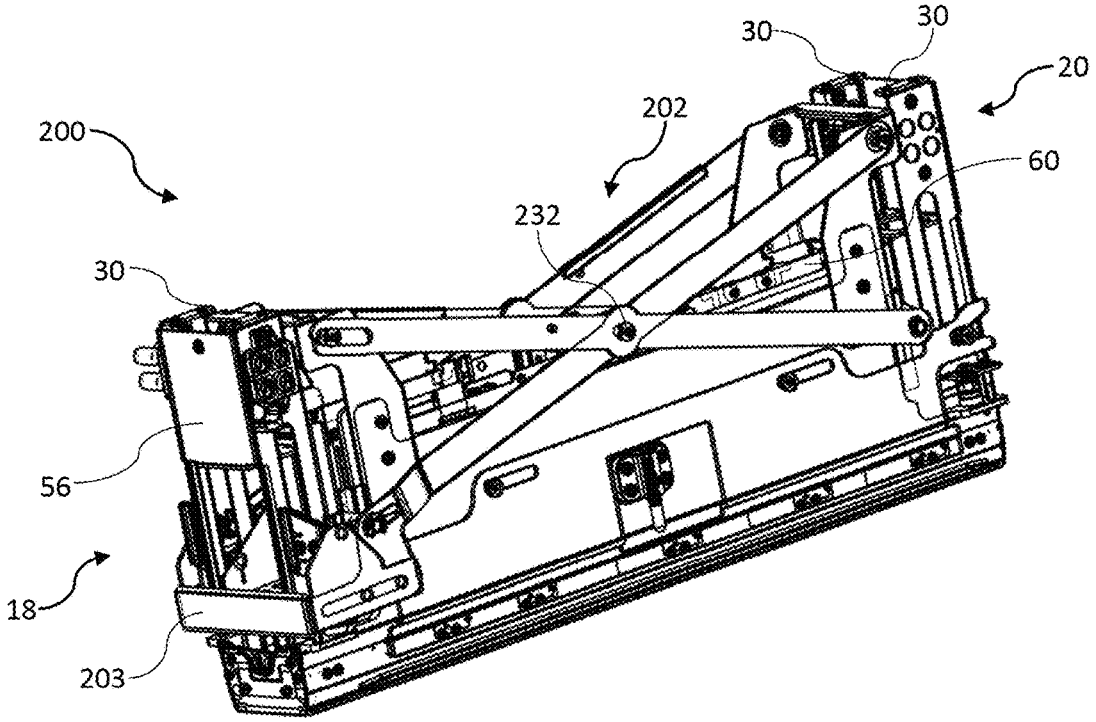
FIG. 24 is a front perspective of a print module according to a second embodiment.
Figure 25:
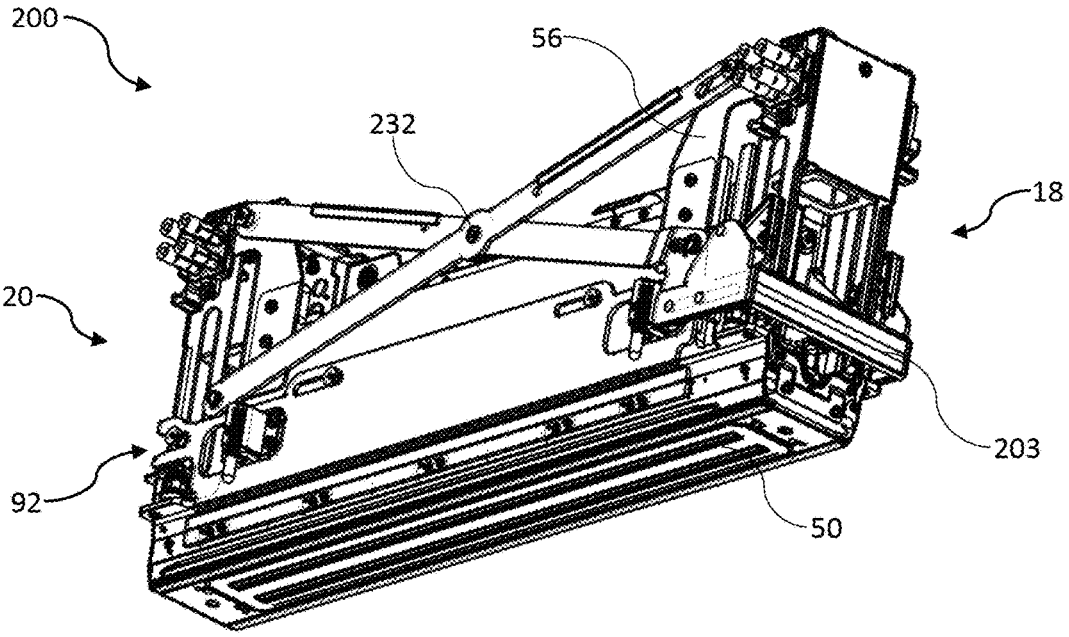
FIG. 25 is a rear perspective of the print module shown in FIG. 24.

Referring to FIGS. 24 and 25, a second print module 200 according to a second embodiment is shown in isolation. The second print module 200 has the same form factor as the first print module 17 and, likewise, serves the primary function of detachably mounting the printhead cartridge 50 (or "printhead 50") shown in FIG. 8. Where relevant, like reference numerals will be used to describe the same or similar features having like functions in the first print module 17 and the second print module 200.

The second print module 200 is designed for fixed attachment to the mounting beam 31 of the print engine 10 (see FIG. 2) and to that end comprises corresponding mounting fixtures 30 at an upper part thereof. In common with the first print module 17, the second print module 200 houses a pair of opposed PCBs 52 and a pair of ink couplings 54 for detachably connecting the PCBs and ink couplings to the printhead 50, thereby enabling printhead insertion/removal. Furthermore, the second print module 200 comprises a cradle 56 and a movable supply assembly 60 in order to effect such ink and electrical connections.

However, the second print module 200 comprises an alternative scissor lift mechanism 202 for moving the supply assembly 60 relative to the cradle 56, as will be described in more detail below. Furthermore, actuation of the scissor lift mechanism 202, the sliding lock mechanism 92 and PCB clamp mechanism is controlled by a single multifunctional actuator handle 203, as opposed to the various handles and levers described above in connection with the first embodiment. Nevertheless, pivoting motion of the printhead carrier 112, with sliding longitudinal movement of the printhead 50 (via the overhead hanger 114) relative to the carrier, for printhead insertion/removal (see FIGS. 16A-C) remains a common feature of the mechanisms used in both the first print module 17 and the second print module 200.

Figure 26:
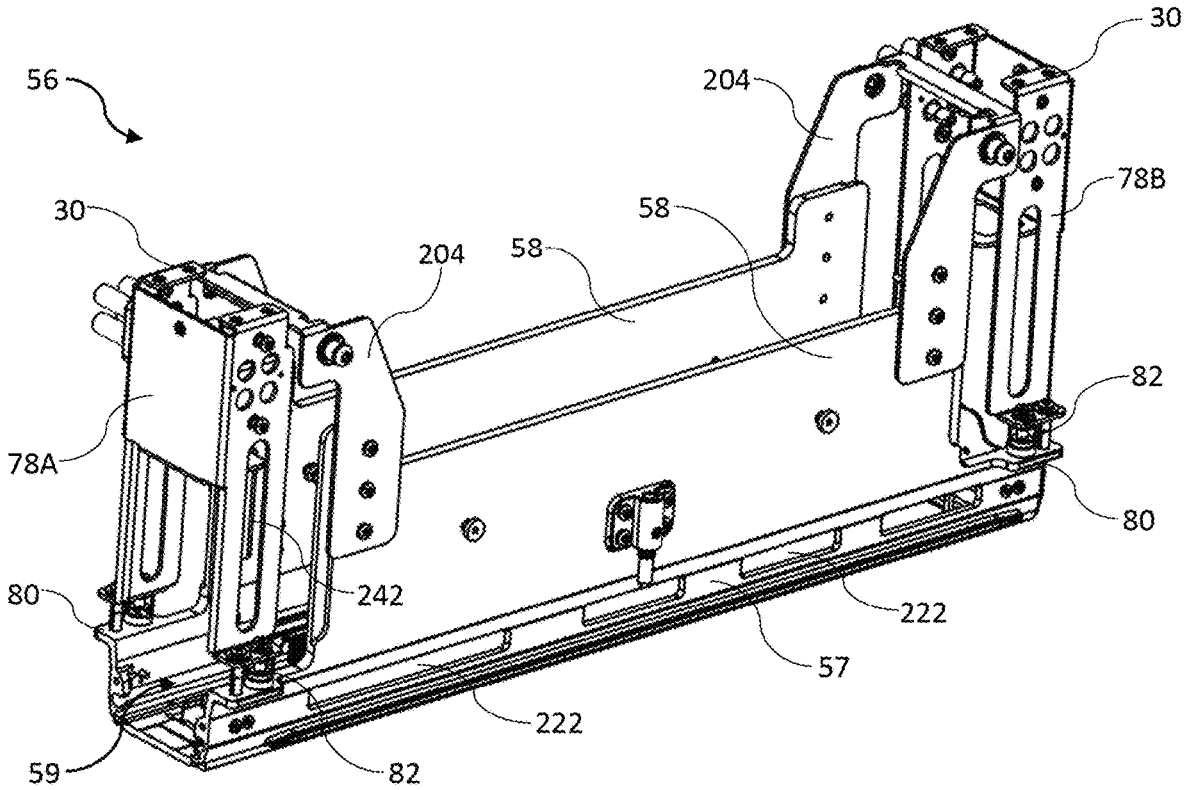
FIG. 26 is a perspective of a cradle for the print module shown in FIG. 24.
Figure 27:
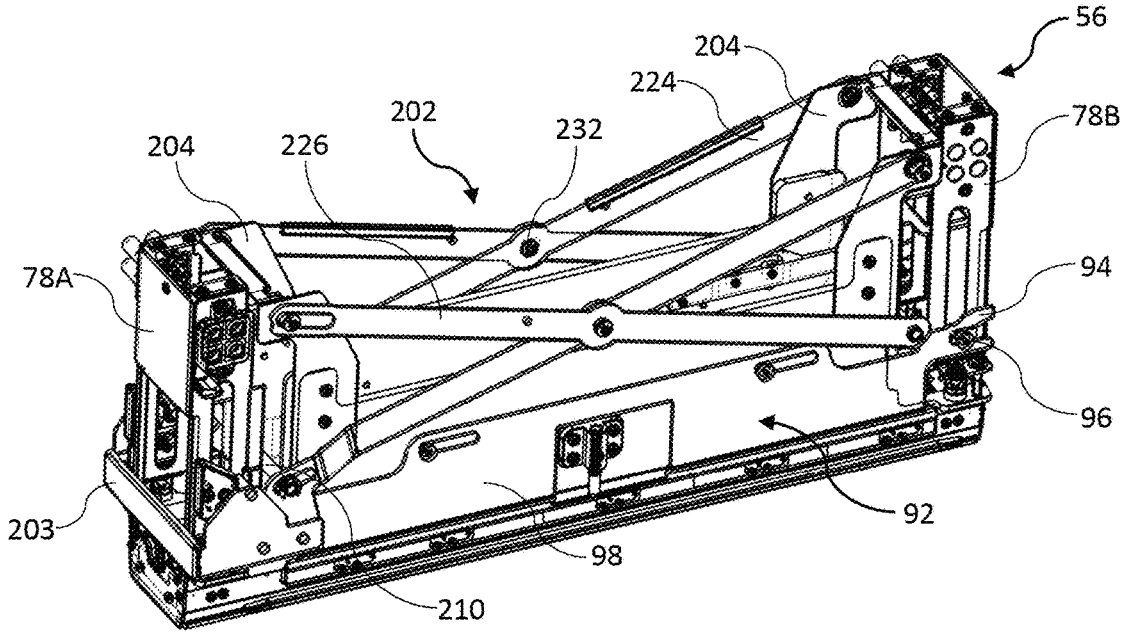
FIG. 27 is a perspective of the cradle shown in FIG. 26 with a scissor lift mechanism.
Figure 28:
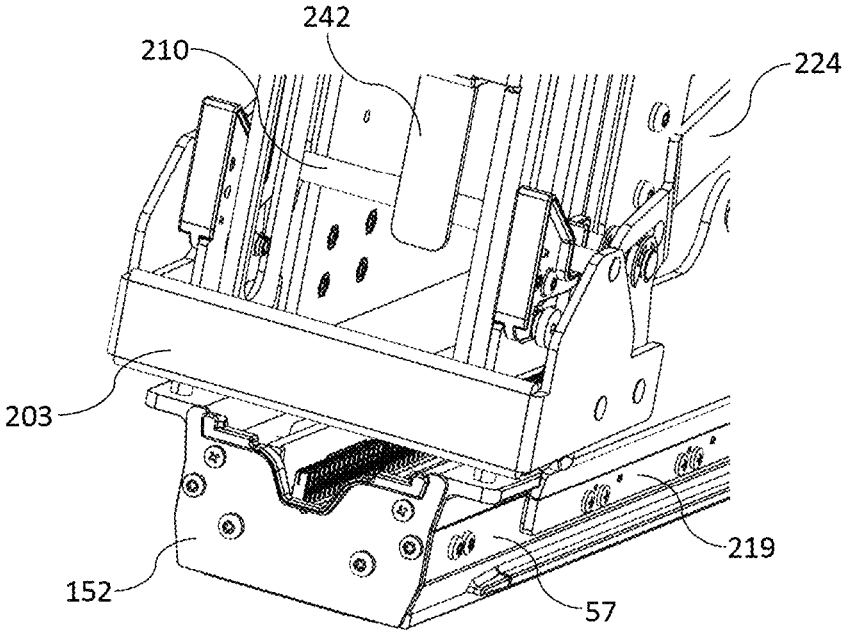
FIG. 28 is a magnified view of a first end of the print module according to the second embodiment.
Figure 29:
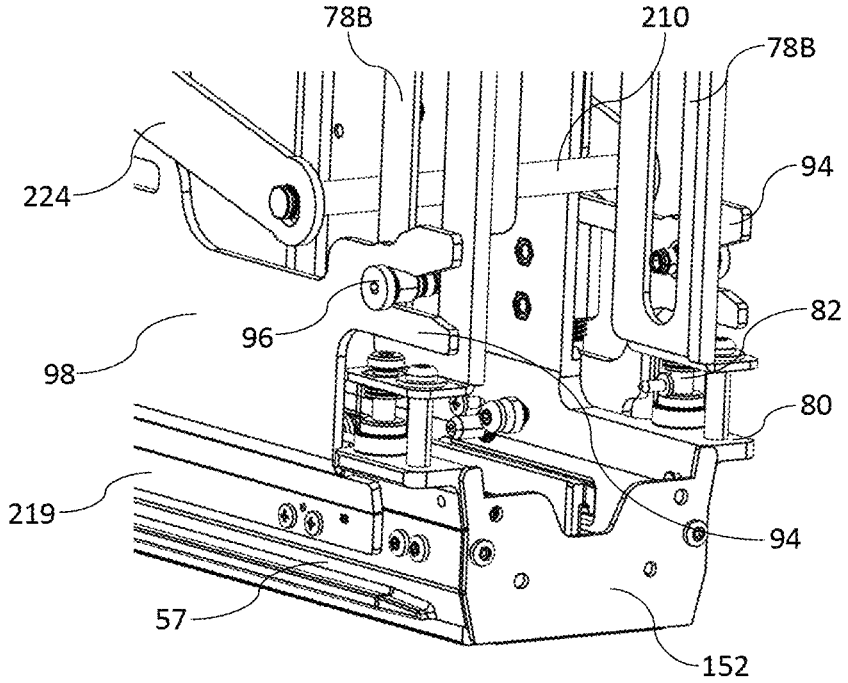
FIG. 29 is a magnified view of a second end of the print module according to the second embodiment.

Referring to FIG. 26, the cradle 56 according to the second embodiment comprises the lower nest 57 defining the longitudinal cavity 59 for receiving the printhead 50; front and rear cradle side plates 58 extending upwardly from the nest; and first and second end housings 78A and 78B fastened to the nest. Each of the first and second end housings 78A and 78B has a foot portion connected to anchor points 80 of the nest 57 and an upper portion having the mounting fixtures 30 for attachment to the mounting beam 31 of the print engine 10. A resilient fastening arrangement 82 is used to attach the end housings 78A and 78B to the anchor points 80 in order to provide a degree of tolerance for the module lift mechanism 19 when datuming the print module 10 into its printing and maintenance positions. In addition, the cradle 56 according to the second embodiment comprises a pair of support brackets 204 fastened between the opposed cradle side plates 58 for supporting the scissor lift mechanism 202. FIGS. 27 to 29 show the cradle 56 according to the second embodiment with the sliding lock mechanism 92, scissor lift mechanism 202 and actuator handle 203. Operations of the sliding lock mechanism 92 and scissor lift mechanism 202 are described in more detail below.

Figure 30:
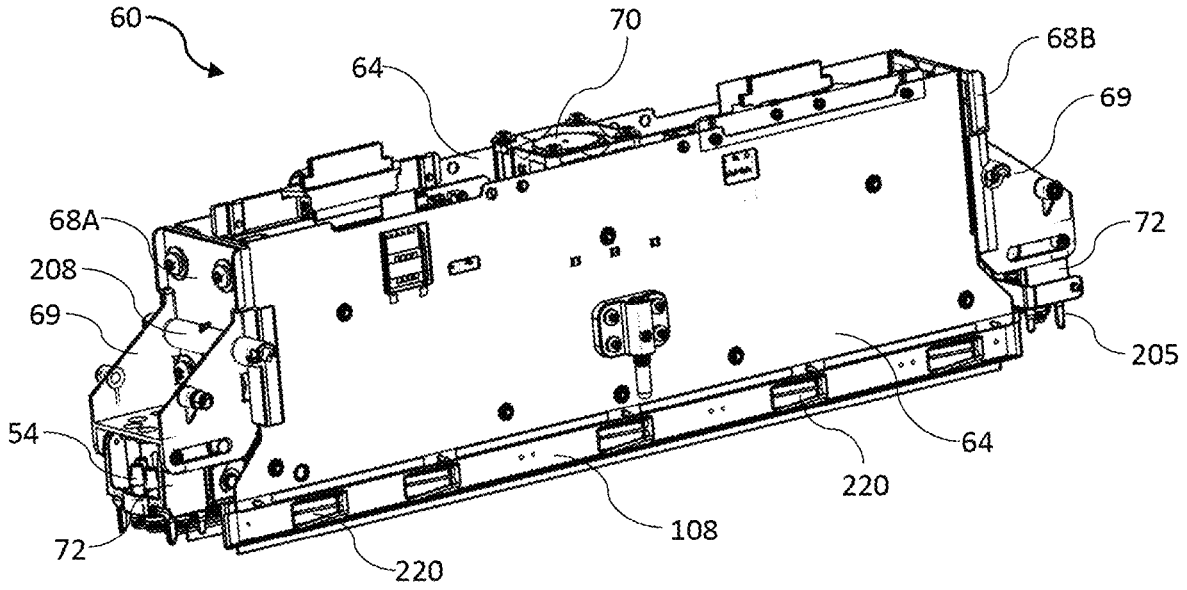
FIG. 30 is perspective of a supply assembly for the print module according to the second embodiment.
Figure 31:
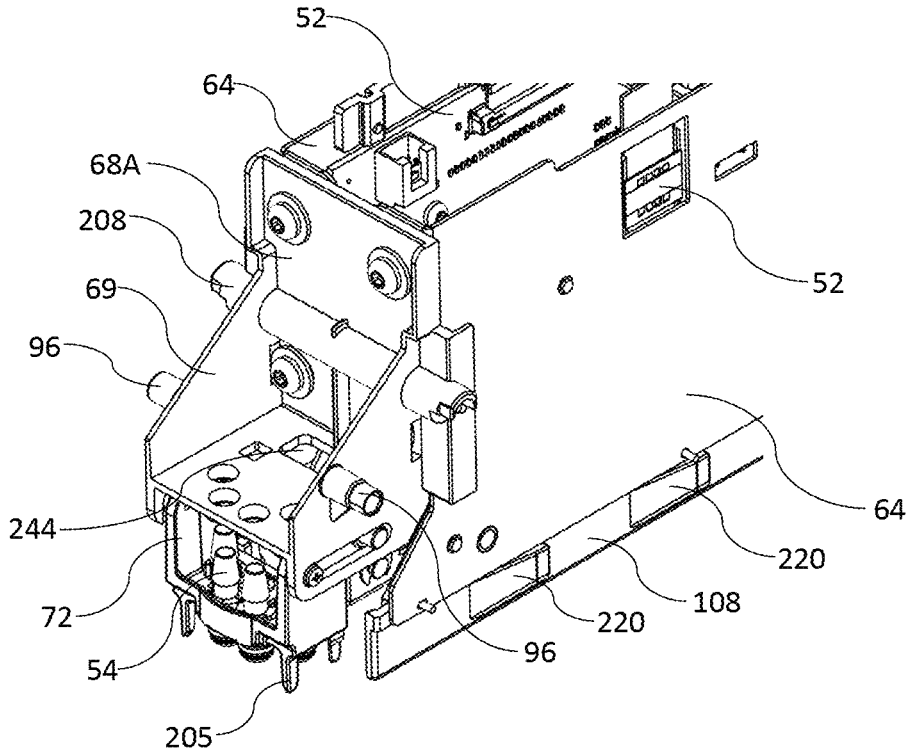
FIG. 31 is a magnified view of a first end of the supply assembly shown in FIG. 30.

The supply assembly 60 according to the second embodiment is shown in isolation in FIGS. 30 and 31. Similar to the first embodiment, the supply assembly 60 according to the second embodiment is slidably received in the cradle 56 between the front and rear cradle side plates 58 and is liftable towards and away from the nest 57.

Similar to the first embodiment, the supply assembly 60 according to the second embodiment also comprises a pair of front and rear PCB mounting plates 64 extending parallel with the cradle side plates 58, each PCB mounting plate having a respective resilient flange 108 at a lower part thereof. The opposed PCBs 52 are each fastened to a respective PCB mounting plate 64 with a space defined between the opposed PCBs. The fan assembly is, likewise, braced between the two PCB mounting plates 64 with the fan 70 and ducting arrangement 71 (not visible in FIGS. 30 and 31) providing airflow into the space between the PCBs 52 for cooling various electronic components (see FIGS. 10 and 11). Structural rigidity is provided by the first and second end brackets 68A and 68B interconnecting the front and rear PCB mounting plates 64. (The front and rear mounting plates 64 together with the first and second end brackets 68A and 68B are collectively a "supply assembly housing").

The first and second end brackets 68A and 68B each have a respective mounting bracket 69 extending longitudinally outwardly therefrom for mounting sets of ink couplings 54 via a respective ink coupling bracket 72 hanging from the mounting bracket. Hence, in the same manner as the first embodiment, the ink couplings 54 are fast with the supply assembly 60 and move in concert with the PCBs 52. Locating pins 205 extending downwardly from the ink coupling bracket 72 are configured to align the ink couplings 54 with corresponding printhead inlet and outlet ports 74 and 75 during engagement of the supply assembly 60 with the printhead 50.

Additionally, each mounting bracket 69 of the supply assembly 60 according to second embodiment comprises a respective sleeve 208 for receiving a lift rod 210 of the scissor lift mechanism 202. The sleeves 208 at each end of the supply assembly 60 therefore provide a means by which the supply assembly may be lifted (and lowered) relative to the cradle 56. The locking pins 96 for locking the scissor lift mechanism 202 project outwardly from either side of each mounting bracket 96.

Features of the scissor lift mechanism 202 and sliding lock mechanism 92 in the print module 200 according to the second embodiment will now be described with reference to a printhead removal operation. Initially, as shown in FIGS. 24 and 25, the sliding lock mechanism 92 is locked with the printhead 50 fully inserted in the print module 200 in a printing configuration. In the printing configuration, all ink couplings 54 are fluidically connected to the printhead 50, the PCB contacts 101 are electrically connected to the printhead contacts 103, and the printhead 50 is datumed against the nest 57.

Figure 32:
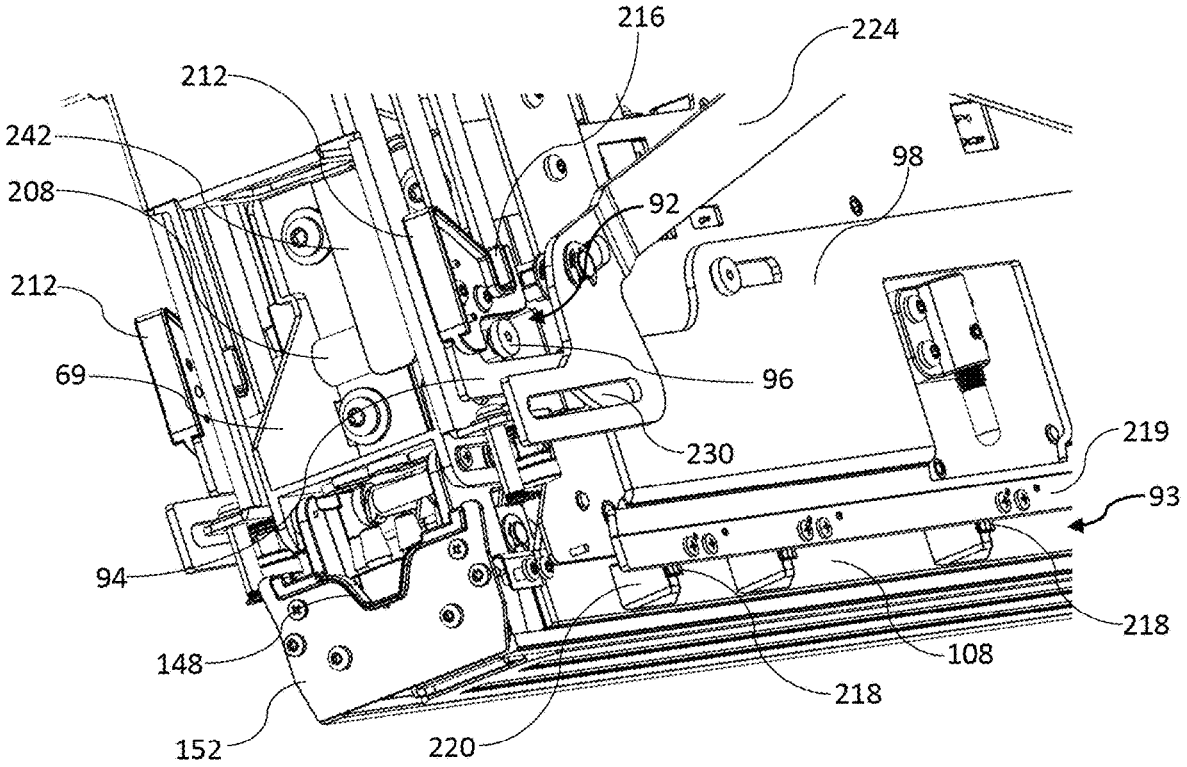
FIG. 32 shows the first end of the print module according to the second embodiment with an actuator handle removed.

FIG. 32 shows the print module 200 with the actuator handle 203 and nest 57 removed to reveal details of both the sliding lock mechanism 92 and PCB clamp mechanism 93. The sliding lock mechanism 92 comprises a pair of slide plates 98, each having a keeper 94 engaged with a corresponding locking pin 96 projecting laterally outwards from each mounting bracket 69 of the supply assembly 60. Each slide plate 98 further comprises a respective slide actuator 212 fast with the slide plate 98 for engagement with the actuator handle 203. A slide plate pin 214 of the actuator handle 203 is engaged with a complementary notch feature 216 of the slide actuator 212 in order to effect longitudinal sliding movement of the slide plate 98. Thus, a user pulling on the handle 203 longitudinally slides the slide plate 98 towards the user and releases the keepers 94 from engagement with the locking pins 96, thereby releasing the supply assembly 60 from its locked position.

Figure 35:
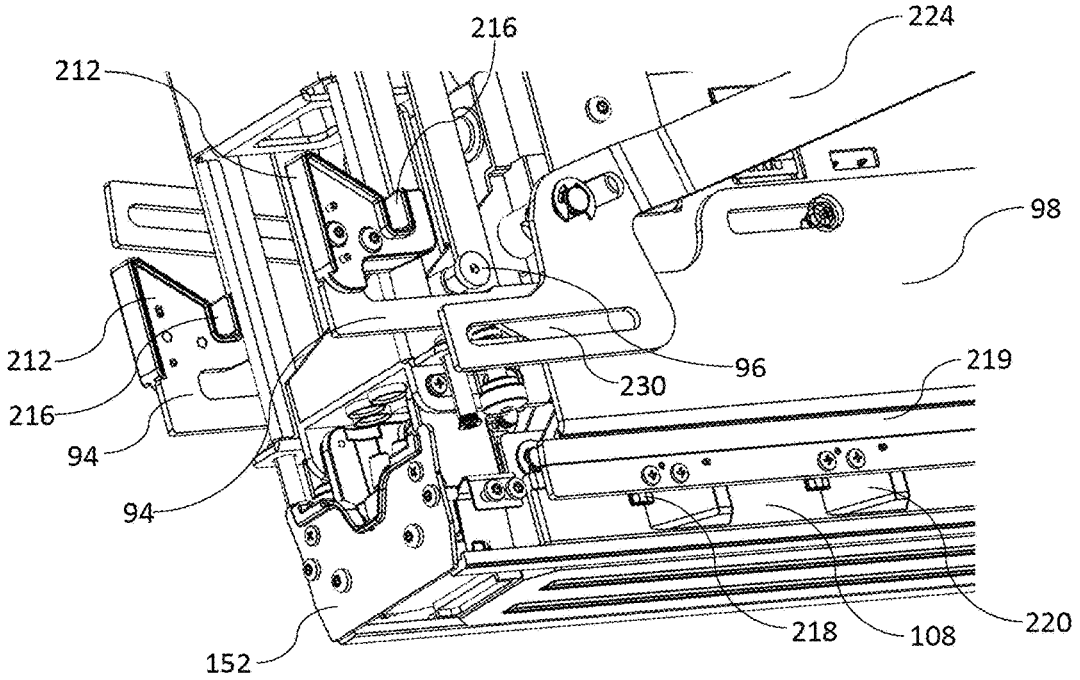
FIG. 35 is a magnified view of the first end of the print module shown in FIG. 34 with the actuator handle removed

As well as releasing the supply assembly 60 from its locked position, longitudinal sliding movement of the slide plate 98 simultaneously unclamps the PCB contacts 101 from the printhead contacts 103. Referring to FIGS. 32 and 35, each slide plate 98 has a plurality of clamps 218 projecting inwardly from a lower clamp portion 219 thereof. Each clamp 218 is engaged with a corresponding cam projection 220 of an adjacent resilient flange 108 by virtue of clamp slots 222 defined in sidewalls of the nest 57 (see FIG. 26). In the locked position shown in FIG. 32, the clamps 218 urge each resilient flange 108 inwards so as to urge the PCB contacts 101 into engagement with the printhead contacts 103. After longitudinal sliding movement of the slide plate 98, as shown in FIG. 35, the clamps 218 release the resilient flanges 108 outwards by virtue of the spring bias of the resilient flanges and the sloping profile of the cam projections 220, thereby disengaging the PCB contacts 101 from the printhead contacts 103. Hence, the slide plate 98, which is longitudinally slidable by pulling on the actuator handle 203, performs the dual functions of releasing the sliding lock mechanism 92 whilst simultaneously releasing the opposed resilient flanges 108 and PCB contacts 101 from an engaged (electrically connected) to a disengaged (electrically disconnected) position.

Figure 33:
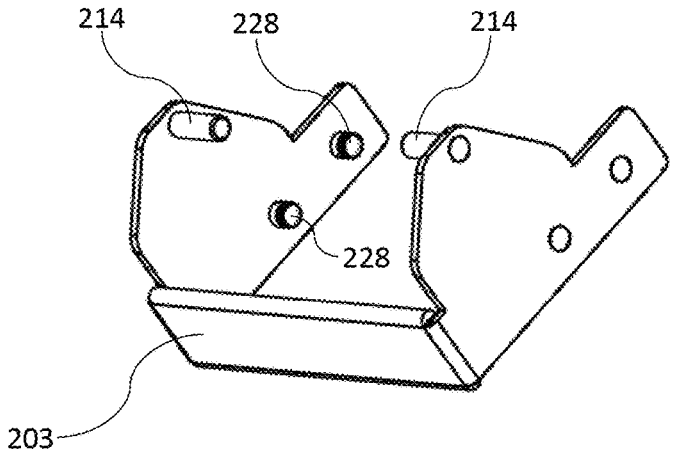
FIG. 33 shows an actuator handle for the print module according to the second embodiment.
Figure 34:
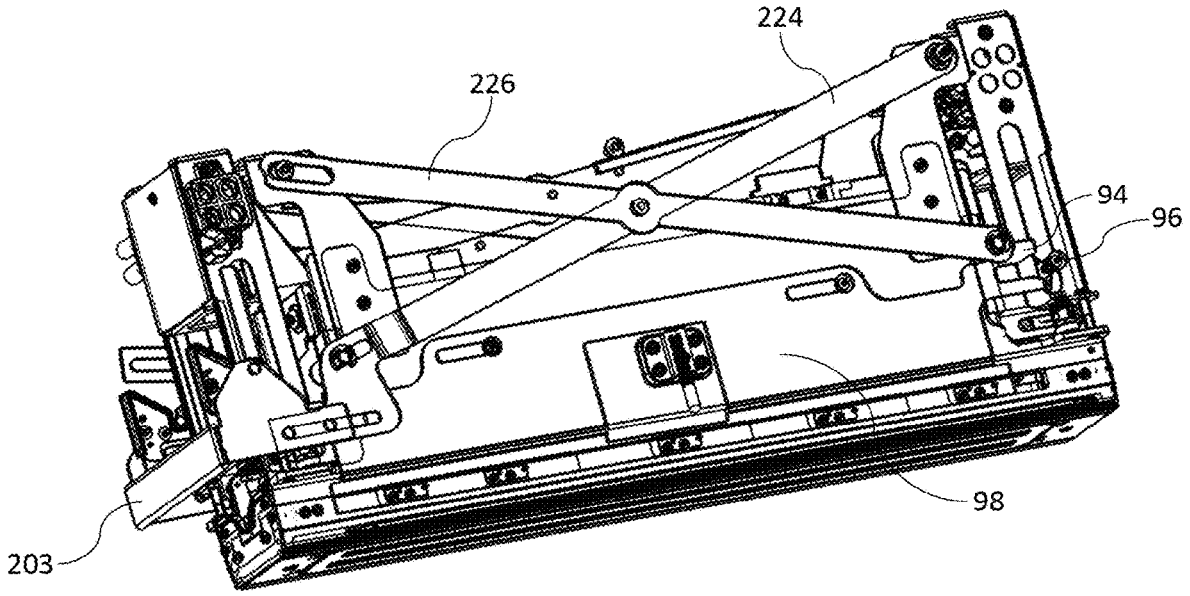
FIG. 34 is a perspective of the print module according to the second embodiment after releasing a sliding lock mechanism.

The actuator handle 203 is not only engaged with the slide plate 98 via the slide plate pins 214 and slide actuator 212, but is also engaged with the scissor lift mechanism 202 for the purpose of lifting and lowering the supply assembly 60, as will now be described. Referring initially to FIG. 27, the scissor lift mechanism 202 comprises a pair of first and second scissor arms 224 and 226 at each side of the print module 200. Each first scissor arm 224 has an upper end pivotally connected to one of the support brackets 204 and a lower end portion connected to the actuator handle 203 via scissor pins 228 of the actuator handle, which are slidably received in a corresponding handle slot 230 defined in the lower end portion of the first scissor arm (see FIGS. 32 and 33). Hence, each of the first scissors arms 224 is configured, by virtue of the slidable scissors pins 228 received in the handle slot 230, to allow sliding movement of the actuator handle 203 for release of the sliding lock mechanism 92, as described above. Returning to FIG. 27, the second scissor arm 226 has an upper end pivotally connected to an opposite support bracket 204 and a midpart pivotally engaged with the first scissor arm to define a scissor axis 232. The parallel pair of first scissor arms 224 are interconnected via a respective lift rod 210 at their lower ends for lifting the supply assembly 60. Likewise, the parallel pair of second scissor arms are interconnected at their lower ends via a respective lift rod 210 (see FIGS. 28 and 29). Each lift rod 210 is received in the sleeve 208 of a corresponding mounting bracket 69 such that motion of the scissor lift mechanism 202 is transferred to linear motion of the supply assembly 60 via the lift rods 210 engaged with their respective sleeves 208.

Figure 36:
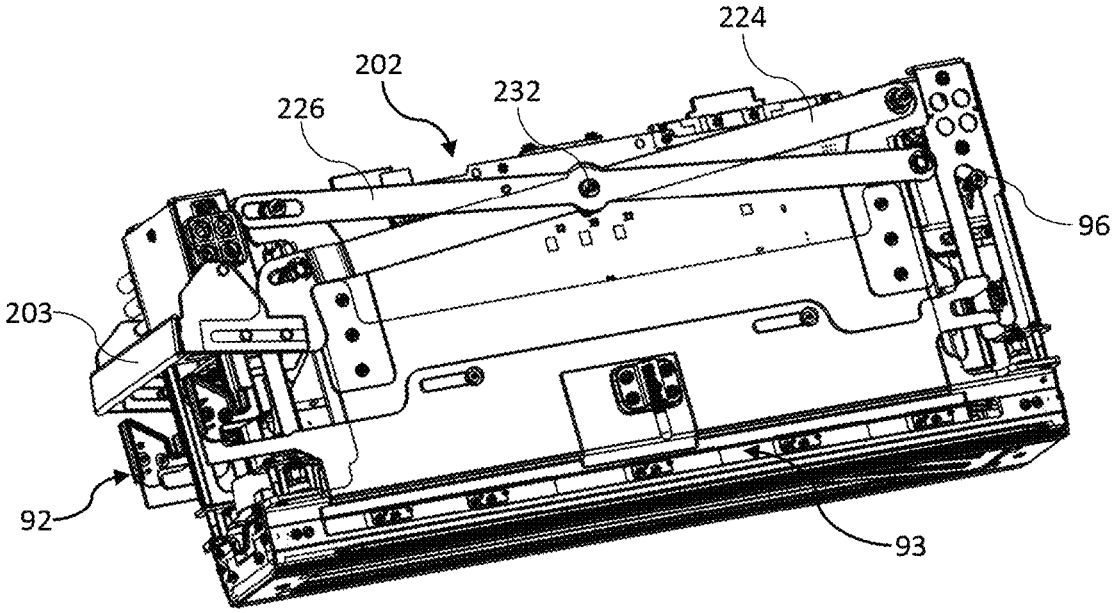
FIG. 36 is a perspective of the print module according to the second embodiment after releasing raising the scissor lift mechanism.
Figure 37:
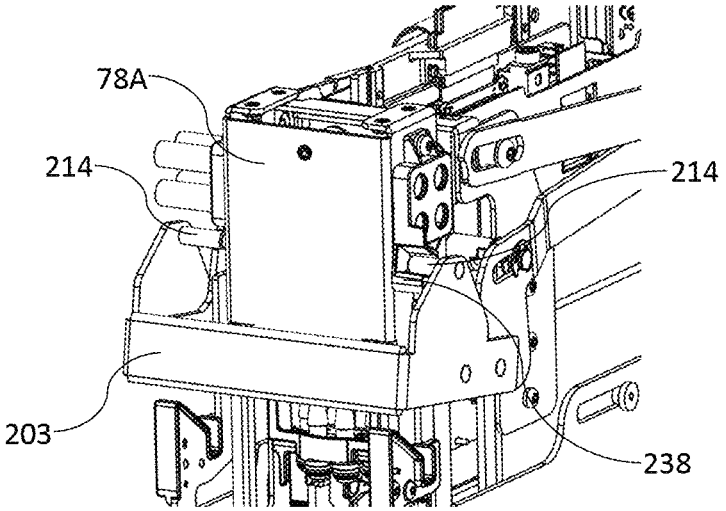
FIG. 37 is a magnified end perspective of the print module shown in FIG. 36.

FIG. 36 shows the print module 200 with the scissor lift mechanism (and supply assembly 60) in its raised position for printhead removal. Thus, in order to raise the supply assembly 60, the user simply grasps the actuator handle 203, pulls it towards him to release the sliding lock mechanism 92 and PCB clamp mechanism 93, as described above, and then raises the actuator handle upwards to actuate the scissor lift mechanism 202. The scissor lift mechanism 202 may be latched in the raised position via engagement between the slide plate pins 214 of the actuator handle 203 and corresponding catches 238 fixed to the first end housing 78A (see FIG. 37). This enables the user to have two free hands in order to pull the printhead 50 longitudinally from the print module 200.

Figure 38:
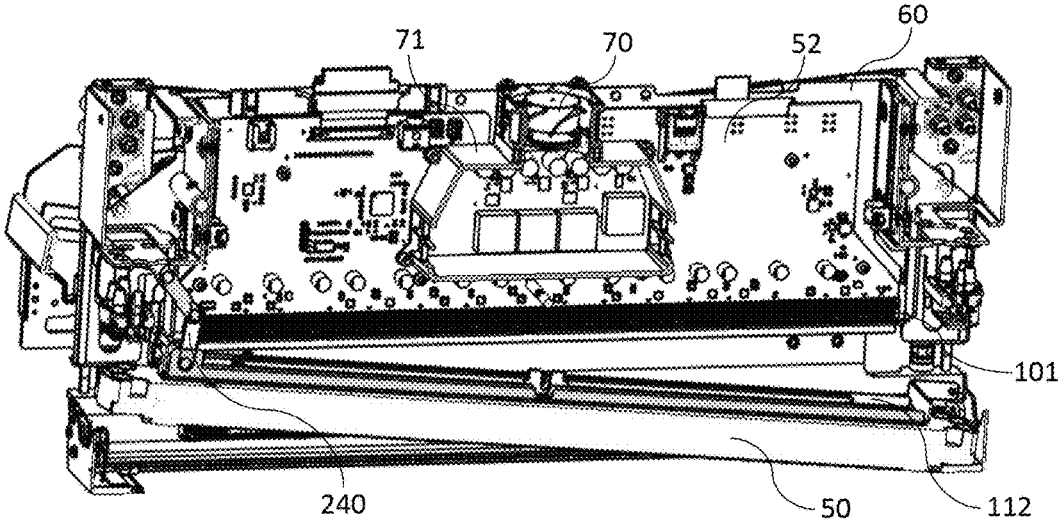
FIG. 38 is a sectional view of the print module shown in FIG. 36.
Figure 39:
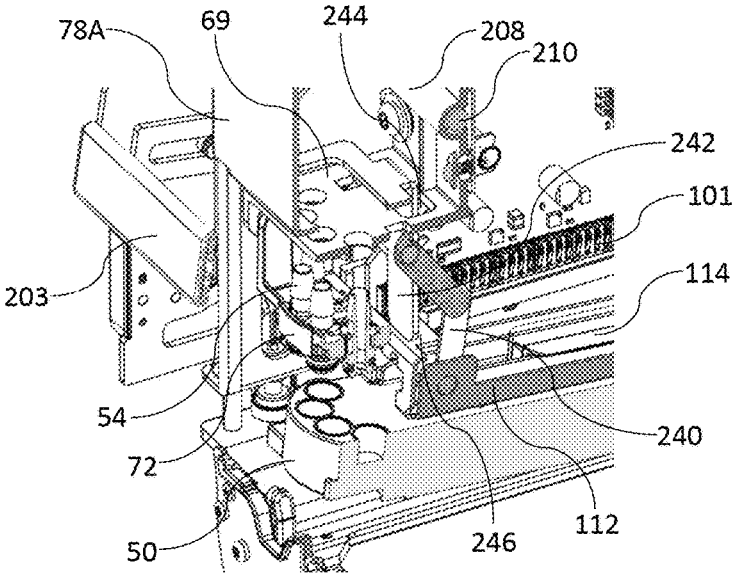
FIG. 39 is a magnified sectional view of the first end of the print module shown in FIG. 36.
Figure 40:
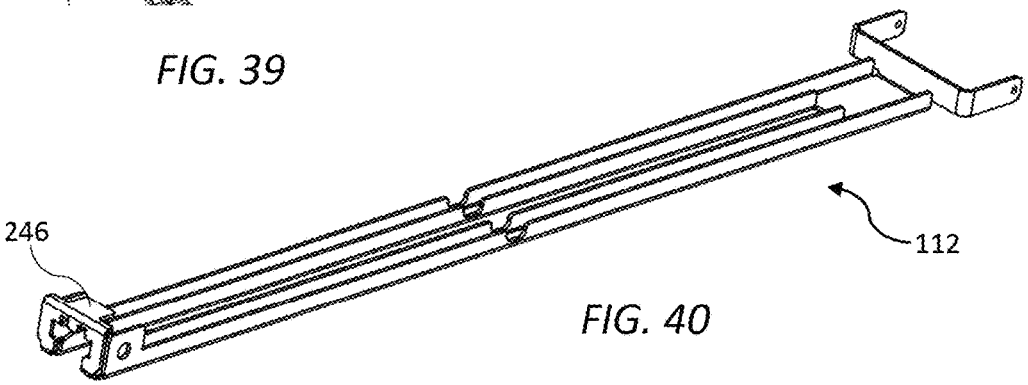
FIG. 40 is a perspective of a printhead carrier according to the second embodiment.

The printhead 50 is slidably received in the printhead carrier 112 via its overhead hanger 114. However, in contrast with the print module 17 according to the first embodiment, the printhead carrier 112 in the second embodiment is connected to the supply assembly 60 via a pair of hinged linkages 240, as best seen in FIGS. 38 and 39. Each hinged linkage 240 has a lower end pivotally connected to the printhead carrier 112 and an upper end pivotally connected to the mounting bracket 69 via the locking pin 96. Hence, upward movement of the supply assembly 60 raises the first end of the printhead carrier 112 via a holding force of the ink couplings 54 at the first end and the hinged linkage 240, whilst the opposite second end of the printhead carrier is pivotally connected to the nest 57, thereby tilting the printhead carrier upwards at the first end for printhead removal as described in connection with schematic FIGS. 16A-C.

With initial upwards movement of the supply assembly 60, the ink couplings 54 at the second end 20 of the print module 200 disconnect from the printhead 50. However, the ink couplings 54 at the first end 18 of the print module 200 do not disconnect simultaneously with the ink couplings at the second end as result of the initial upward movement of the printhead 50 and printhead carrier 112. In order to achieve fluid disconnection at the first end of the printhead 50, a fixed tongue 242 depends downwardly from the first end housing 78A for engagement with the printhead carrier 112. During upward movement of the supply assembly 60, the tongue 242 passes through a tongue slot 244 of the mounting bracket 69 and butts against a reaction plate 246 at the first end of the printhead carrier 112. The tongue 242, therefore, limits upward movement of the printhead carrier 112 and allows the ink couplings 54 at the first end to be pulled away from and disconnect from the printhead 50. Meanwhile, the hinged linkage 240 extends further and continues to support the printhead carrier 112 as the support assembly 60 moves upwards for fluidic disconnection. Advantageously, the ink couplings 54 at the first end 18 and second end 20 are disconnected separately, which reduces the force requirements for disconnection compared to the first embodiment whereby the two sets of ink couplings are disconnected simultaneously.

In FIG. 39, the hinged linkage is shown extended with the tongue butting the reaction plate 246 of the printhead carrier 112 and the ink couplings 54 at both ends of the printhead 50 disconnected. In this configuration, the printhead 50 is ready to be slidingly removed from the printhead carrier by the user and replaced. For printhead replacement, the user performs reverse sequence of steps to those described above: the replacement printhead 50 is initially longitudinally slid into the printhead carrier 112; the user grasps the actuator handle 203 and unlatches it from the catch 238; the user then moves the actuator handle 203 downwards to actuate the scissor lift mechanism 202 and move the supply assembly 60 downwards—this movement makes fluidic connections between the ink couplings 54 and inlet/outlet ports at both ends of the printhead 50 and also datums the printhead into the nest 57; finally, the user pushes the actuator handle 203 inwards (i.e. away from the user) to actuate the PCB clamp mechanism 93 and form electrical connections, as well as actuate the sliding lock mechanism 92 to lock the supply assembly 60 in the printing position.

It will, of course, be appreciated that the present invention has been described by way of example only and that modifications of detail may be made within the scope of the invention, which is defined in the accompanying claims.

The invention claimed is:

1. A print module comprising:

a cradle having a longitudinal cavity;

an elongate printhead assembly positioned in the longitudinal cavity;

a supply assembly slidably movable relative to the cradle along an axis perpendicular to a longitudinal axis of the printhead assembly, the supply assembly comprising a PCB fastened to a PCB mounting plate, the PCB mounting plate having a resilient flange configured for clamping engagement with a portion of the PCB containing PCB contacts; and a slide plate slidably movable relative to the cradle along an axis parallel to the longitudinal axis of the printhead assembly, the slide plate being configured for camming engagement with the resilient flange, wherein sliding movement of the slide plate urges the resilient flange into clamping engagement with said portion of the PCB, thereby electrically connecting the PCB contacts with the printhead.

2. The print module of claim 1, wherein the slide plate comprises a plurality of clamps engaged with complementary cam projections of the resilient flange.

3. The print module of claim 1 comprising a pair of opposed PCBs, each PCB mounted on a respective mounting plate, and wherein sliding movement of opposite slide plates urges respective resilient flanges into clamping engagement with respective portions of the PCBs, thereby electrically connecting the PCB contacts of each PCB with the printhead.

4. The print module of claim 3, wherein the printhead has opposite rows of printhead contacts for connection to opposed rows of PCB contacts.

5. The print module of claim 3, wherein a single actuator handle is operatively connected to each of the opposite slide plates.

6. The print module of claim 5, wherein the actuator handle comprises slide plate pins operatively connected to the slide plates.

7. The print module of claim 1, wherein the slide plate has one or more keepers, and wherein each keeper is engageable with a locking pin projecting from the supply assembly.

8. The print module of claim 7, wherein the slide plate is configurable between a locked position in which each locking pin is engaged with a respective keeper and an unlocked position in which each locking pin is disengaged from respective keeper.

9. The print module of claim 8, wherein the PCB contacts are electrically connected to the printhead in the locked position.

10. The print module of claim 8, wherein the locked position is a printing configuration of the print module.

11. The print module of claim 8, wherein the printhead is urged against a lower nest of the cradle in the locked position.

12. The print module of claim 11, wherein one or more thrust pins of the supply assembly urge the printhead against the nest.

13. The print module of claim 8, wherein each locking pin projects transversely with respect to the longitudinal axis of the printhead assembly.

* * * * *